US007607656B2

(12) United States Patent
Yoshida

(10) Patent No.: US 7,607,656 B2
(45) Date of Patent: Oct. 27, 2009

(54) IMAGE FORMING APPARATUS AND IMAGE FORMING METHOD

(75) Inventor: Kazuhiko Yoshida, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 144 days.

(21) Appl. No.: 11/638,418

(22) Filed: Dec. 14, 2006

(65) Prior Publication Data

US 2007/0278734 A1 Dec. 6, 2007

(30) Foreign Application Priority Data

Jun. 1, 2006 (JP) ..... 2006-153472

(51) Int. Cl.
*B65H 3/52* (2006.01)

(52) U.S. Cl. ..... 271/121; 271/124

(58) Field of Classification Search ..... 271/121, 271/124

See application file for complete search history.

(56) References Cited

U.S. PATENT DOCUMENTS 4,394,009 A * 7/1983 Bergman et al. ..... 271/10.12
5,201,508 A * 4/1993 Kuo ..... 271/10.03
5,823,524 A * 10/1998 Kawada ..... 271/124
6,082,726 A * 7/2000 Inoue et al. ..... 271/4.08
6,145,831 A * 11/2000 Inoue et al. ..... 271/121
2002/0003332 A1 * 1/2002 Hiratani ..... 271/121
2002/0074712 A1 6/2002 Yano

FOREIGN PATENT DOCUMENTS

JP 2002-179271 6/2002
JP 2003-128283 5/2003

* cited by examiner

*Primary Examiner*—David H Bollinger
(74) *Attorney, Agent, or Firm*—Morgan, Lewis & Bockius LLP

(57) ABSTRACT

An image forming apparatus includes: an image forming part; a sheet container that contains sheets fed to the image forming part in a stacked state; a feed roller that feeds the sheet from the sheet container; a separation member in press-contact with the feed roller that separates the sheet at a contact point formed between the feed roller and the separation member; and a press-contact force reducing unit that reduces a press contact force of the separation member to the feed roller while maintaining an approximately constant sheet separating force with the separation member.

8 Claims, 20 Drawing Sheets

IMAGE FORMING APPARATUS AND IMAGE FORMING METHOD

BACKGROUND

1. Technical Field

The present invention relates to a method and an apparatus for forming an image by use of a copier, a facsimile machine or a printer.

2. Related Art

In this type of image forming apparatus, having a sheet container containing stacked sheets, a feed roller to feed the sheet contained in the sheet container toward an image forming part, and a press-contact member in press-contact with the feed roller, a technique of handling the sheet at a contact point formed between the feed roller and the press-contact member, thereby preventing multi-sheet feed is known.

SUMMARY

According to an aspect of the invention, there is provided an image forming apparatus, including; an image forming part; a sheet container that contains sheets fed to the image forming part in a stacked state; a feed roller that feeds the sheet from the sheet container; a separation member in press-contact with the feed roller that separates the sheet at a contact point formed between the feed roller and the separation member; and a press-contact force reducing unit that reduces a press contact force of the separation member to the feed roller while maintaining an approximately constant sheet separating force with the separation member.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described with reference to the drawings.

Figure 1:
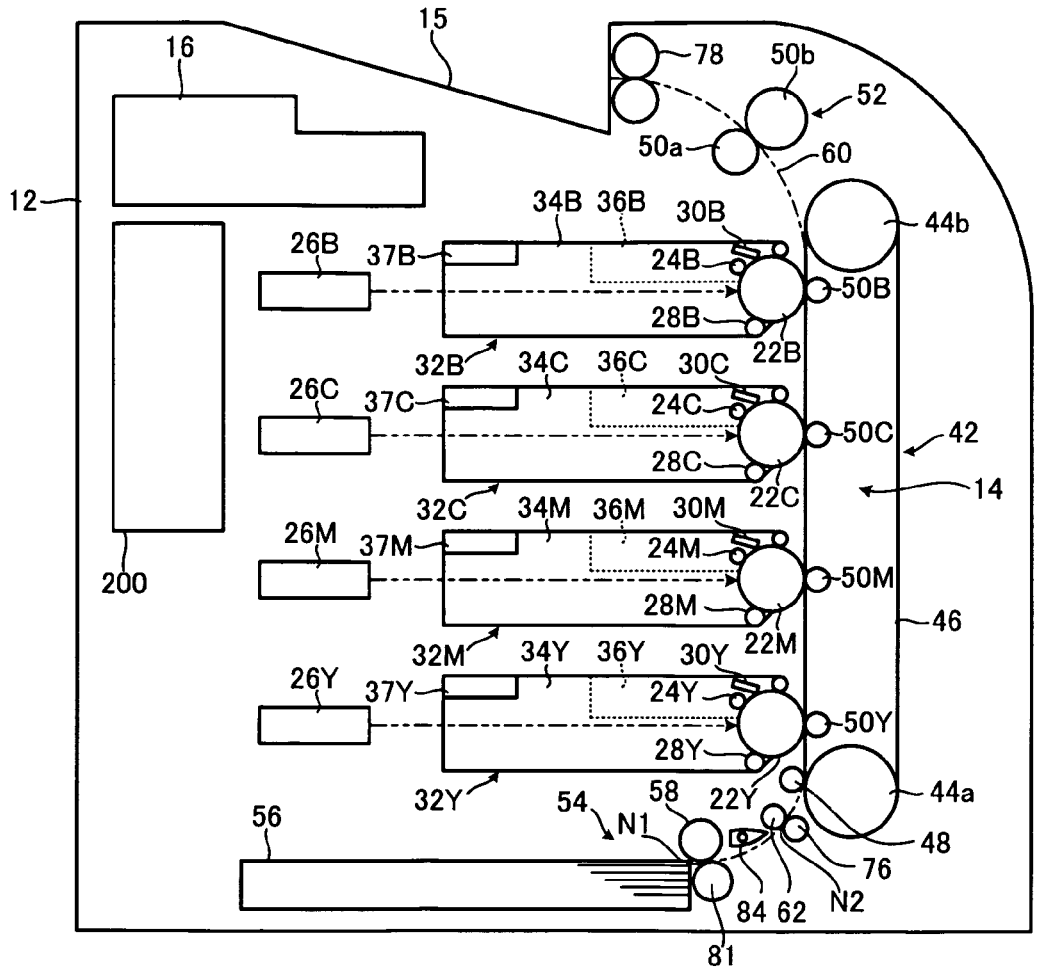
FIG. 1 is a cross-sectional view showing a schematic structure of an image forming apparatus according to a first exemplary embodiment of the present invention.

FIG. 1 shows an image forming apparatus 10 according to a first exemplary embodiment of the present invention. The image forming apparatus 10 has an image forming apparatus main body 12. The image forming apparatus main body 12 includes an image forming part 14, a sheet feeder 54 to feed a sheet to the image forming part 14, a power source unit 16, and a controller 200 used as a controller. Further, a sheet discharge unit 15, to which a sheet after image formation is discharged, is provided in an upper part of the image forming apparatus main body 12.

The image forming part 14 is an electrophotographic type unit to form a color image. The image forming part 14 has drum-shaped photoreceptors 22Y, 22M, 22C and 22B as image holders to hold developing material images, chargers 24Y, 24M, 24C and 24B as charging units having charging rollers to uniformly charge the respective photoreceptors 22Y, 22M, 22C and 22B, optical writers 26Y, 26M, 26C and 26B as latent-image forming units to optically write latent images on the respective photoreceptors 22Y, 22M, 22C and 22B, developing devices 28Y, 28M, 28C and 28B as developing units to develop the latent images written on the respective photoreceptors 22Y, 22M, 22C and 22B with developing material (toner), a transfer unit 42 as a transfer unit to transfer the developing material images formed on the respective photoreceptors 22Y, 22M, 22C and 22B to a sheet, and cleaners 30Y, 30M, 30C and 30B as developing-material removal units to remove the developing material remaining on the photoreceptors 22Y, 22M, 22C and 22B after the transfer of the developing material images by the transfer unit 42.

The optical writers 26Y, 26M, 26C and 26B respectively have a laser exposure device. The optical writer 26Y emits a laser beam corresponding to a yellow image to the photoreceptor 22Y; the optical writer 26M emits a laser beam corresponding to a magenta image to the photoreceptor 22M; the optical writer 26C emits a laser beam corresponding a cyan image to the photoreceptor 22C; and the optical writer 26B emits laser beam corresponding to a black image to the photoreceptor 22B. In this manner, the optical writers 26Y, 26M, 26C and 26B respectively write latent images on the photoreceptors 22Y, 22M, 22C and 22B.

Among the members included in the image forming part 14, the photoreceptor 22, the charger 24, the developing device 28 and the cleaner 30 are integrated as a process cartridge 32 used as an exchangeable unit. The process cartridge is attachable/detachable to/from the image forming apparatus main body 12. Further, the process cartridge 32 has a toner cartridge (toner bottle) 34 as a developing material container (exchangeable unit) containing developing material (toner) supplied to the developing devices 28, and a discharge toner bottle 36 as a developing-material collecting container to collect developing material (toner) removed by the cleaner 30, attachably/detachably or integrally with the process cartridge 32.

In the image forming apparatus main body 12, the process cartridges 32Y, 32M, 32C and 32B are arrayed, in this order, from a lower position toward an upper position in FIG. 1, along a conveyance belt 46 to be described later.

The process cartridge 32Y is used for image formation with yellow developing material; the process cartridge 32M is used for image formation with magenta developing material; the process cartridge 32C is used for image formation with cyan developing material; and the process cartridge 32B is used for image formation with black developing material. Accordingly, the toner cartridge 34Y is filled with yellow toner; the toner cartridge 34M is filled with magenta toner; the toner cartridge 34C is filled with cyan toner; and the toner cartridge 34B is filled with black toner.

The transfer unit 42 is provided in contact with the photoreceptors 22Y, 22M, 22C and 22B of the process cartridges 32Y, 32M, 32C and 32B. The transfer unit 42 has two support rollers 44*a* and 44*b*, the conveyance belt 46 as a conveyance unit to convey a sheet or image, an attachment roller 48 as an attachment unit to attach the sheet to the conveyance belt 46, and transfer rollers 50Y, 50M, 50C and 50B to transfer developing material images formed on the respective photoreceptors 22Y, 22M, 22C and 22B onto the sheet conveyed with the conveyance belt 46, integrated as a unit.

The attachment roller 48 is provided in press-contact with the support roller 44*a* via the conveyance belt 46. The attachment roller 48 receives a voltage applied from the power source unit 16 and electrostatically attaches the sheet to the conveyance belt 46.

A transfer bias is applied to the respective transfer rollers 50Y, 50M, 50C and 50B, to sequentially transfer developing material images formed on the photoreceptors 22Y, 22M, 22C and 22B to the sheet conveyed with the conveyance belt 46, thus a color developing-material image is formed with overlaid four color images, i.e., yellow, magenta, cyan and black developing material images.

Further, a fixing device 52 to fix the developing material image, transferred on the sheet by the transfer unit 42, onto the sheet, is provided in the upper part of the image forming apparatus main body 12. The fixing device 52, having a heating roller 52*a* and a pressure roller 52*b*, fixes the developing material image to the sheet by heating and pressing the sheet passing between the heating roller 52*a* and the pressure roller 52*b*.

Further, a conveyance path 60 to convey a sheet supplied from the sheet feeder 54 to the sheet discharge unit is provided in the image forming apparatus main body 12. Along the conveyance path 60, registration rollers 62 and 76, the transfer unit 42, the fixing device 52 and a discharge roller 78 are provided sequentially from the upstream side of sheet conveyance direction. The discharge roller 78 discharges the sheet conveyed from the fixing device 52 to the sheet discharge unit 15. Further, in a position of the conveyance path 60 upstream of the registration rollers 62 and 76 in the sheet conveyance direction, a sensor 84 is provided. The sensor 84 is used as a detection unit to detect timing of arrival of an end of the sheet at a contact point N2 formed with the registration rollers 62 and 76.

The sheet feeder 54 has a sheet feed cassette 56 used as a sheet container, a feed roller 58 to feed a sheet from the sheet feed cassette 56 toward the image forming part 14, and a handling roller 81 used as a separation member.

The sheet feed cassette 56, in which sheets such as normal sheets or OHP sheets are stacked, is provided attachably/detachably to/from the image forming apparatus main body 12. The handling roller 81, in press-contact with the feed roller 58, forms a contact point N1 between the feed roller 58 and the handling roller 81, handles and separates the sheet supplied from the sheet feed cassette 56 in the contact point N1, thereby prevents multi-sheet feed.

Figure 2:
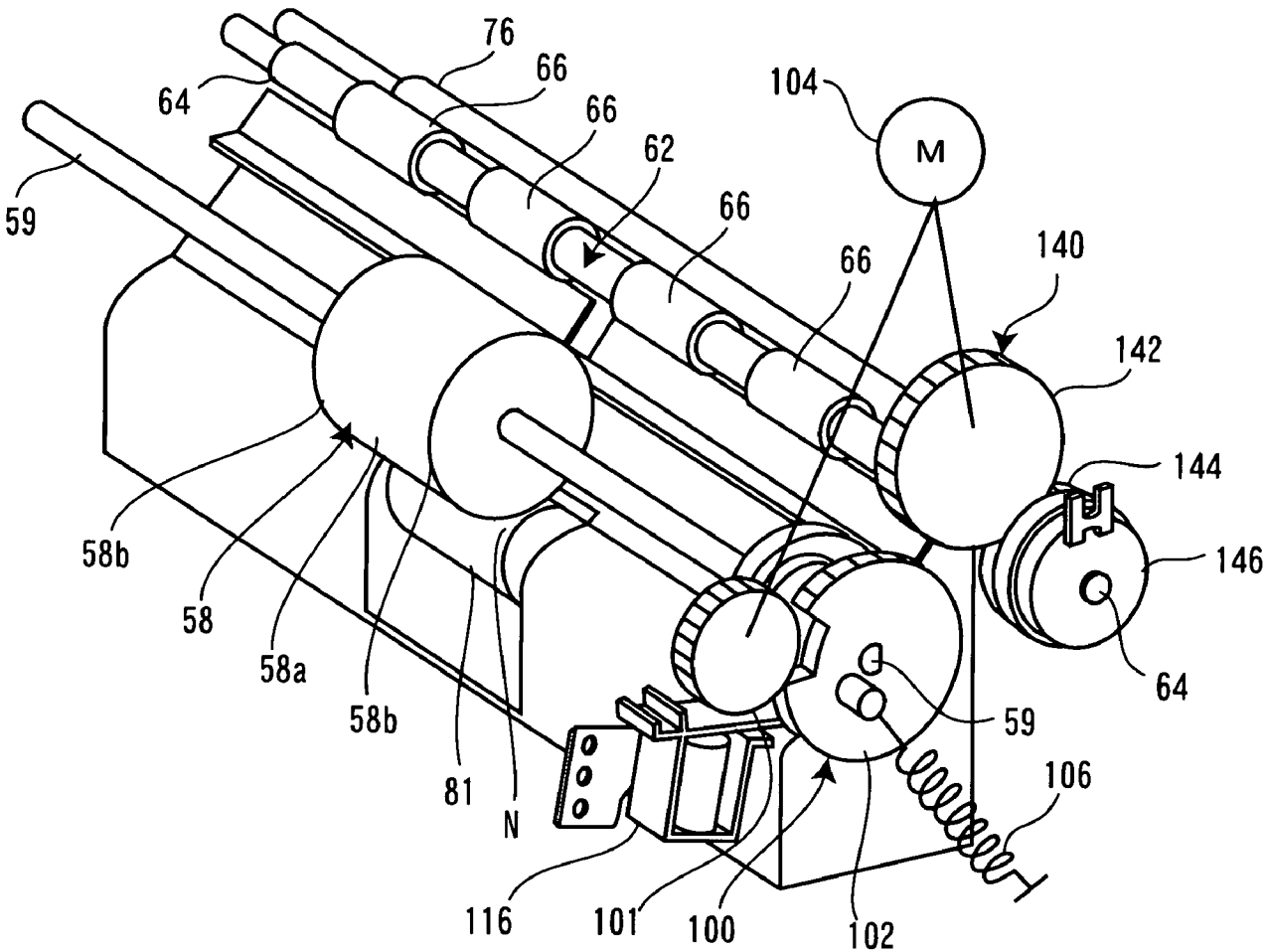
FIG. 2 is an expanded perspective view of a portion around a feed roller used in the image forming apparatus according to the first exemplary embodiment of the present invention.

FIG. 2 is an expanded perspective view of a portion around the feed roller 58, the registration roller 62 and the registration roller 76 of the sheet feeder 54.

The feed roller 58 has a core 58*a* fixed to a rotation shaft 59, and disk-shaped skids 58*b* provided at both ends of the core 58*a*. The core 58*a* has a diameter slightly larger than that of the skids 58*b*, and eccentric from the rotation shaft 59 by the large-diameter portion. The skids 58*b* of the feed roller 58 are rotated in contact with the handling roller 81 in accordance with rotation of the rotation shaft 59. As the core 58*a* having a meniscus shape is eccentric, when the skids 58*b* are rotated, the core 58*a* is rotated intermittently in contact with a sheet on the top of the sheet pile stacked on the sheet feed cassette 56, thereby the top sheet is fed. At this time, when plural sheets are held at the contact point N1 formed with the feed roller 58 and the handling roller 81, the handling roller 81 is stopped or reverse-rotated, so as to cause slipping between the sheets and feed only the top sheet.

The registration roller 62, as a driving side, rotates in the same direction as the sheet conveyance direction at predetermined timing. The registration roller 76, as a driven side, is rotated in accordance with the rotation of the registration roller 62. The registration roller 62 has a rotation shaft 64 and four cores 66 fixed to the rotation shaft 64. The cores 66 are provided with rubber having a high surface friction force on their outer peripheral surfaces. The registration roller 76 is in press-contact with the cores 66 of the registration roller 62. The registration roller 76 has at least a surface of a material such as metal with a frictional coefficient lower than that of the surface of the registration roller 62.

A registration roller driving mechanism 140 to rotate the registration roller 62 in the same direction as the sheet conveyance direction is attached to the registration roller 62. The registration roller driving mechanism 140 has a driving gear 142 and a driven gear 144. The driving gear 142 receives drive transmission from the motor 104 used as a drive source and rotates. The driven gear 144, engaged with the driving gear 142, is fixed to the rotation shaft 64 via an electromagnetic clutch 146. Accordingly, when the driving gear 142 receives the drive transmission from the motor 104 and starts rotation, the rotation is transmitted to the driven gear 144 and the driven gear 144 starts rotation. Even when the driven gear 144 has started rotation, the rotation of the driven gear 144 is not transmitted to the rotation shaft 64 as long as the electromagnetic clutch 146 is OFF. On the other hand, when the electromagnetic clutch 146 is turned ON, the rotation of the driven gear 144 is transmitted to the rotation shaft 64, and the rotation shaft 64 and the registration roller 62 start rotation in the sheet conveyance direction.

Figure 3A:
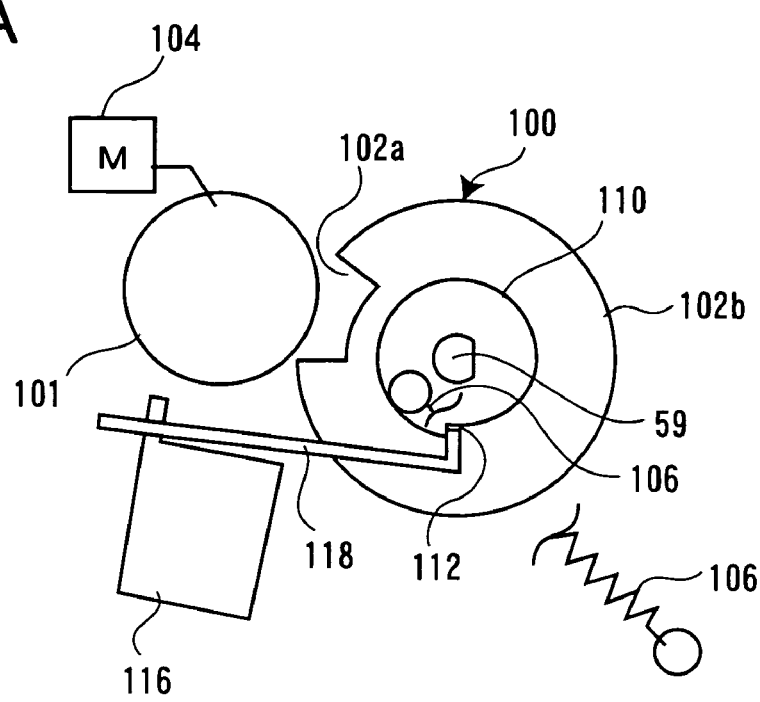
FIG. 3A is an explanatory view of a feed roller driving mechanism used in the image forming apparatus according to the first exemplary embodiment of the present invention, showing a state prior to start of sheet feed.
Figure 3B:
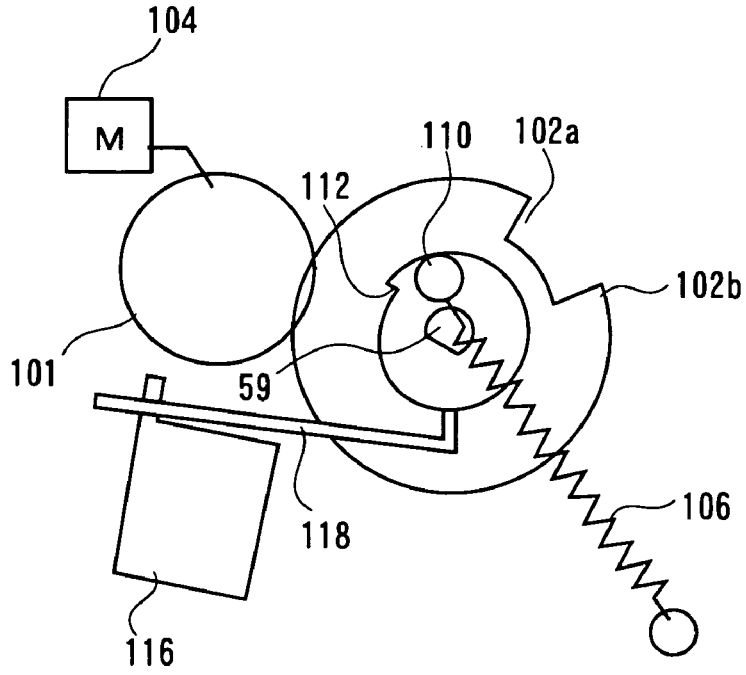
FIG. 3B is an explanatory view of the feed roller driving mechanism used in the image forming apparatus according to the first exemplary embodiment of the present invention, showing a state during the sheet feed.

FIG. 2 and FIGS. 3A and 3B show a feed roller driving mechanism 100 to rotate-drive the feed roller 58 in the sheet conveyance direction.

The feed roller driving mechanism 100 has a driving gear 101, a driven gear 102 and a feed solenoid 116. The driving gear 101 receives drive transmission from the above-described motor 104 and rotates. The driven gear 102 is a notched gear fixed to one end of the rotation shaft 59. The driven gear 102 has a notch portion 102*a* having no tooth. When the notch portion 102*a* is opposite to the driving gear 101, the driving gear 101 runs idle, and the driving from the driving gear 101 is not transmitted to the driven gear 102. The driven gear 102 is connected to one end of a pressure unit 106 having an elastic body such as an extension spring, and the driven gear 102 is pressurized in one direction with the pressure unit 106. Further, a cylindrical member 110 having a step member 112 is fixed to the rotation shaft 64 to which the driven gear 102 is fixed. The feed solenoid 116 has a movable member 118, and the movable member 118 is engaged with the step member 112 formed in the cylindrical member 110.

Accordingly, when the feed solenoid 116 is driven from the state shown in FIG. 3A, the engagement between the movable member 118 and the step member 112 is released. Then the driven gear 102 rotates counterclockwise by the pressure of the pressure unit 106 in FIG. 3A, and the driving gear 101 engages with a gear portion 102*b* of the driven gear 102. In this state, drive transmission is performed from the driving gear 101 to the driven gear 102, and the feed roller 58 starts rotation in the sheet conveyance direction together with the driven gear 102 and the rotation shaft 59. When sheet feed from the sheet feed cassette 56 has been completed, the feed roller driving mechanism 100 returns to a state as shown in FIG. 3B.

In the image forming apparatus 10 having the above construction, a sheet is fed from the sheet feed cassette 56 with the feed roller 58, then the sheet handled with the handling roller 81 is supplied to the contact point N2 formed with the registration rollers 62 and 76. The sheet is supplied from the contact point N2 to the image forming part 14, and a developing material image is formed on the sheet in the image forming part 14.

Figure 4A:
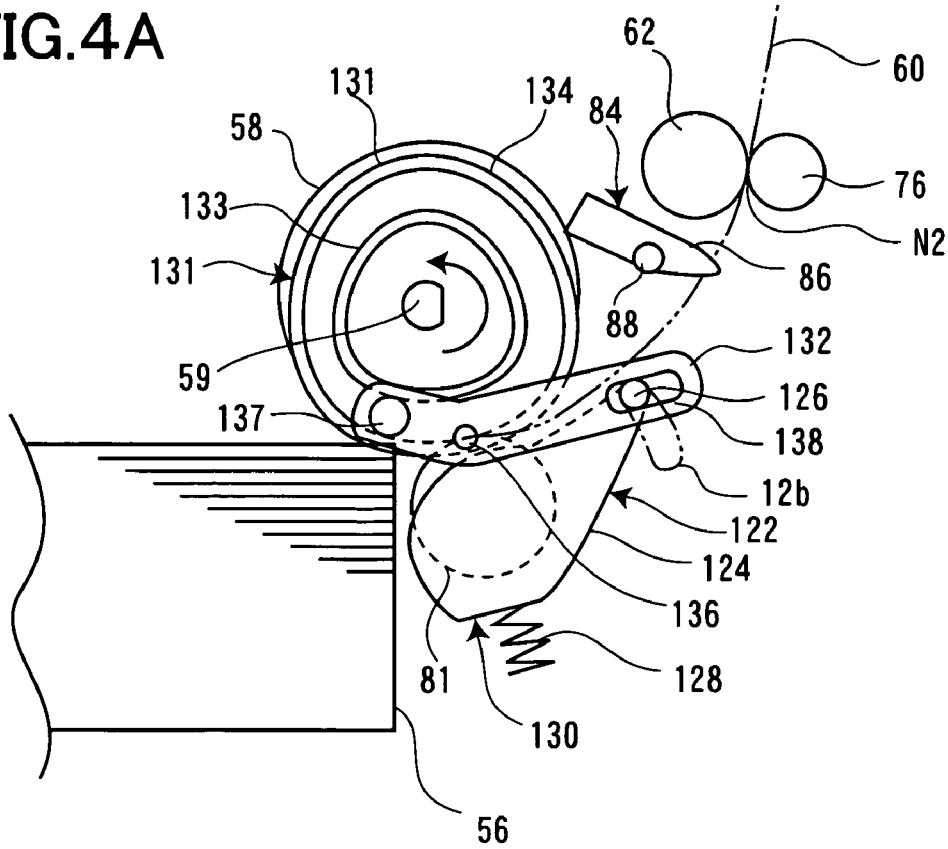
FIG. 4A is an explanatory view of a rocking shaft moving mechanism used in the image forming apparatus according to the first exemplary embodiment of the present invention, showing a state during sheet conveyance with a registration roller.
Figure 4B:
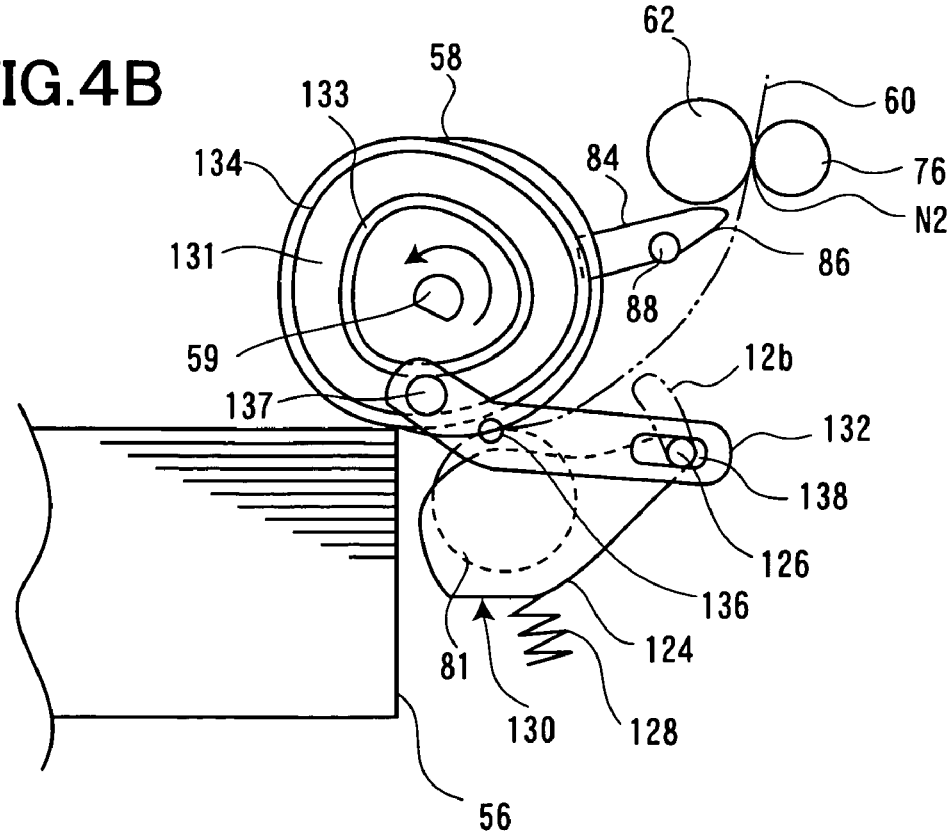
FIG. 4B is an explanatory view of the rocking shaft moving mechanism used in the image forming apparatus according to the first exemplary embodiment of the present invention, showing a state during sheet feed with the feed roller.
Figure 5:
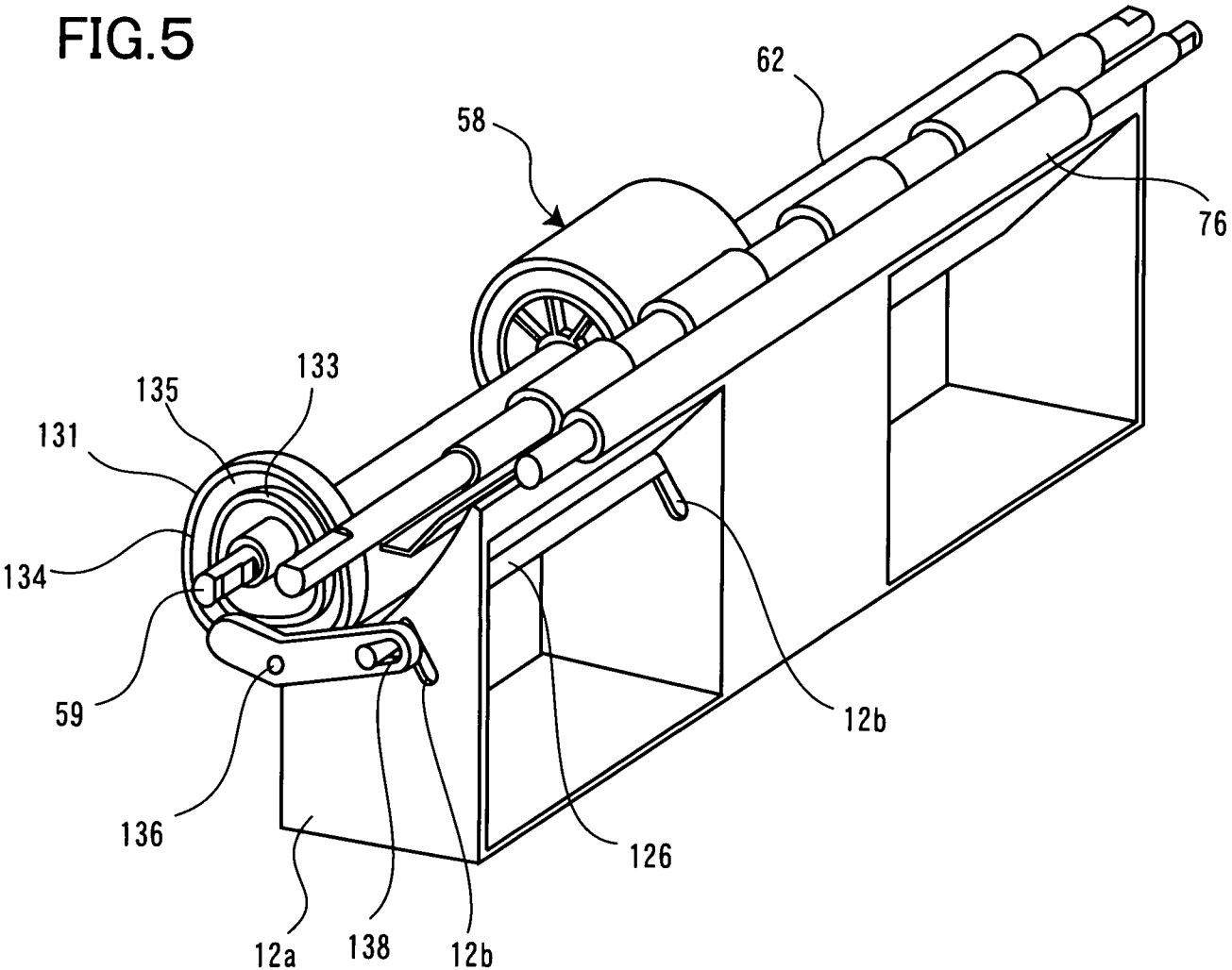
FIG. 5 is an expanded perspective view of a portion around the rocking shaft moving mechanism used in the image forming apparatus according to the first exemplary embodiment of the present invention.

FIGS. 4A and 4B and FIG. 5 show a press-contact force reducing mechanism 122 used as a press-contact force reducing unit to reduce the press-contact force to bring the handling roller 81 into press-contact with the feed roller 58. The press-contact force reducing mechanism 122 has a rocking member 124 and a rocking shaft moving mechanism 130 to move a rocking shaft 126 of the rocking member 124. The rocking member 124 is rockably provided with respect to the image forming apparatus main body 12. The rocking member 124 supports the handling roller 81 via a torque limiter around its one end, and has a rocking shaft 126 used as a rocking fulcrum at the other end. The rocking shaft 126, formed in a frame 12*a* as a part of the image forming apparatus main body 12, is inserted in guide holes 12*b* used as guide units. The rocking shaft 126, guided with the guide holes 12*b*, is movable between a position shown in FIG. 4A and a position shown in FIG. 4B. Further, one end of an elastic body 128 such as a spring used as a pressure unit is in contact with the end of the rocking member 124 opposite to the side where the feed roller 58 is provided. The other end of the elastic body 128 is fixed to the image forming apparatus main body 12. The elastic body 128 pressurizes the handling roller 81 by its elastic force via the rocking member 124 in the direction of the feed roller 58, and brings the handling roller 81 into press-contact with the feed roller 58.

In the present exemplary embodiment, the rocking member 124 is attached to the frame 12*a* as a part of the image forming apparatus main body 12, however, as long as it is rockable with respect to the image forming apparatus main body 12, it may be attached to other unit than the image forming apparatus main body 12. For example, it may be arranged such that guide holes corresponding to the guide holes 12*b* are formed in the sheet feed cassette 56, and the rocking member 124 is attached to the sheet feed cassette 56 using these guide holes.

The rocking shaft moving mechanism 130 has a cam 131 coupled with the feed roller 58 via the rotation shaft 59 and a lever 132 which rocks upon reception of pressure from the cum 131. The cam 131 has an inner wall 133 horizontal with respect to an axial direction of the rotation shaft 59 and an outer wall 134 formed outside the inner wall 133. The distance from the rotation shaft 59 to the surface of the inner wall 133 facing the outer wall 134 differs in accordance with position, thus the surface is eccentric from the rotation shaft 59. The interval between the outer wall 134 on the inner wall 133 side and the inner wall 133 is constant. The space between the inner wall 133 and the outer wall 134 forms a groove 135.

The lever 132 is rockably supported with a shaft 136. A projection 137 is formed toward the cam 131 side in a position of the lever 132 around one end, and the projection 137 is engaged with the groove 135 formed in the cum 131. An insertion hole 138, in which the rocking shaft 126 of the rocking member 124 is inserted, is formed around the end of the lever 132 opposite to the end where the projection 137 is formed. The insertion hole 138, having a width slightly greater than the diameter of the rocking shaft 126, extends from a position around the end of the lever 132 in the direction of the shaft 136.

The above-described sensor 84 is provided in a position downstream of the lever 132 in the sheet conveyance direction and upstream of the contact point N2 formed with the registration rollers 62 and 76. The sensor 84 detects timing of arrival of the end of the sheet at the contact point N2 and detects timing of passing of a rear end of the sheet through the contact point N2.

The sensor 84 has a movable member 86 rotatably supported with a shaft 88. As shown in FIG. 4A, when a sheet is not conveyed on the conveyance path 60, the movable member 86 is in a position crossing the conveyance path 60. From this state, when a sheet has been fed with the feed roller 58, the end of the sheet pushes the movable member 86, and against pressure by a pressure unit having a spring (not shown), rotates the movable member 86 about the shaft 88, to move the movable member 86 outside the conveyance path 60 as shown in FIG. 4B. Then the movement of the movable member 86 is detected by an optical sensor (not shown), thus the timing of arrival of the end of the sheet at the contact point N2 is detected. When the rear end of the sheet passes through the position of the sensor 84, the movable member 86 is pressurized by the pressure unit, and again moves to the position crossing the conveyance path 60 shown in FIG. 4A. Then the movement is detected by an optical sensor (not shown), thus the timing of passing of the rear end of the sheet through the contact point N2 is detected.

In the press-contact force reducing mechanism 122 having the above construction, upon start of sheet feed from the sheet feed cassette 56, the rocking shaft 126 is in the position shown in FIG. 4A. From this state, when the rotation of the rotation shaft 59 is started, and the sheet feed with the feed roller 58 is started, the cam 131 coupled with the rotation shaft 59 starts rotation in an arrow direction in FIGS. 4A and 4B. When the cam 131 starts-rotation, the projection 137 of the lever 132 is pressurized with the outer wall 134 of the cam 131, and the lever 132 rotates clockwise about the shaft 136. When the lever 132 rotates, the rocking shaft 126 inserted in the insertion hole 138 of the lever 132 moves downward, while being guided with the guide holes 12*b*, to the position shown in FIG. 4B. Then, when the rotation shaft 59 continues rotation, the rocking shaft 126 again moves to the position shown in FIG. 4A.

In accordance with design of the cam 131, the rocking shaft 126 is in the position shown in FIG. 4B before the end of the sheet conveyed with the feed roller 58 arrives at the registration rollers 62 and 76. When the end of the sheet arrives at the contact point N2 and while it is held at the contact point N2, the rocking shaft 126 is in the position shown in FIG. 4A.

Figure 6A:
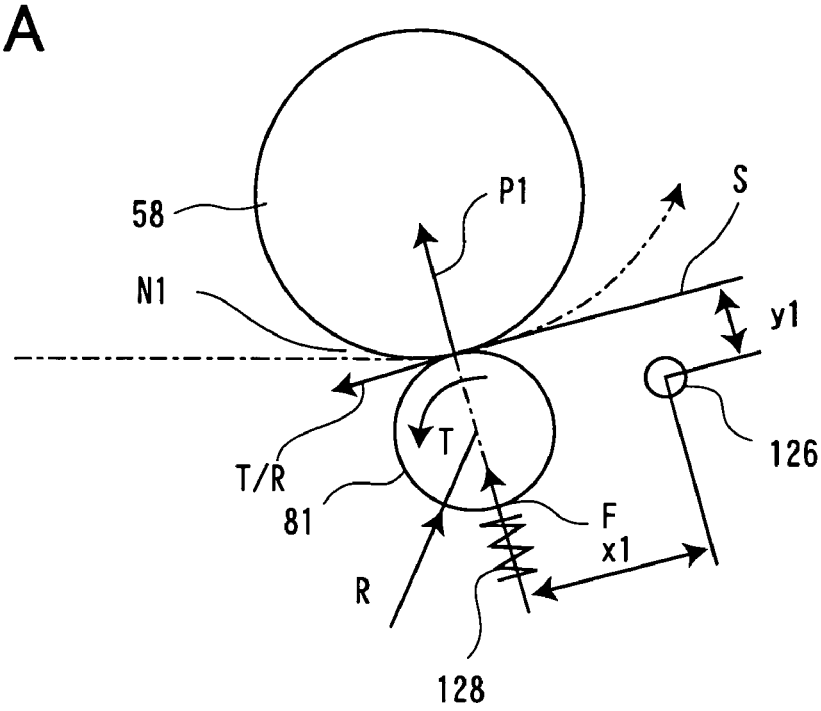
FIGS. 6A and 6B are explanatory views of an operation of a contact-pressure force reducing mechanism used in the image forming apparatus according to the first exemplary embodiment of the present invention.
Figure 6B:
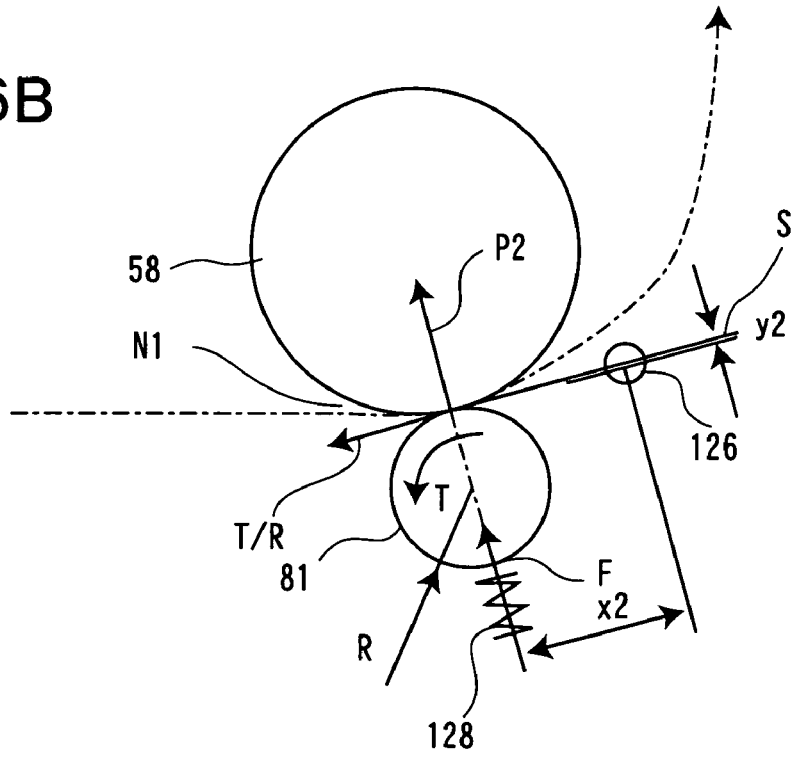

FIGS. 6A and 6B show the influence of the movement of the rocking shaft 126 on the press-contact force to bring the handling roller 81 in press-contact with the feed roller 58 and on the separating force to handle and separate the sheet with the handling roller 81. The position of the rocking shaft 126 in FIG. 6A is the same as that in FIG. 4A. Further, the position of the rocking shaft 126 in FIG. 6B is the same as that in FIG. 4B.

In FIGS. 6A and 6B, assuming that the radius of the handling roller 81 is R, and the slip torque of the torque limiter attached to the handling roller 81 is T, the sheet separating force is T/R and is constant regardless of whether the rocking shaft 126 is in the position shown in FIG. 6A or in the position shown in FIG. 6B. Note that the sheet separating force means a force applied to a sheet in the lowest position, when plural sheets have been supplied to the contact point N1, from the handling roller 81, in the tangent direction of the feed roller 58 and in an opposite direction to the sheet conveyance direction.

When the rocking shaft 126 is in the position shown in FIG. 6A, assuming that the force bringing the handling roller 81 into contact with the feed roller 58 (contact pressure) is p1, the distance between the center of the handling roller 81 in a direction parallel to a tangent plane s of the feed roller 58 passing through the contact point N1 and the center of the rocking shaft 126 is x1, and the distance between the tangent plane s and the rocking shaft 126 is y1, the contact pressure p1 is expressed as follows from the balance of moment about the rocking shaft 126 as a center.

$$p1=(T/F)\times y1/x1$$

The handling roller 81 is in press-contact with the feed roller 58 with the above-described elastic body 128 such as a spring. Then contact pressure P1, obtained by adding a spring load F of the elastic body 128 to the contact pressure p1, is expressed as follows.

$$P1=F+(T/F)\times y1/x1$$

Further, when the rocking shaft 126 is in the position shown in FIG. 6B, assuming that the force bringing the handling roller S1 into contact with the feed roller 58 (contact pressure) is p2, the distance between the center of the handling roller 81 in a direction parallel to the tangent plane s of the feed roller 58 passing through the contact point N1 and the center of the rocking shaft 126 is x2, and the distance between the tangent plane s and the rocking shaft 126 is y2, the contact pressure P2, obtained by adding the spring load F to the contact pressure p2, is expressed as follows.

$$P2=F+(T/F)\times y2/x2$$

In the state shown in FIG. 6B, the rocking shaft 126 is approximately positioned on the tangent plane s. Accordingly, the distance y2 is approximately 0, and the value of the contact pressure P2 is approximately equal to F.

In this manner, in the present exemplary embodiment, the rocking shaft moving mechanism 130 moves the rocking shaft 126 to the position approximately on the tangent plane s of the feed roller 58 at the contact point N1, thereby reduces the press contact force of the handling roller 81 to the teed roller 58 from P1 to P2, while maintaining the sheet separating force T/R of the handling roller 81 constant. Accordingly, when the sheet is held at the contact point N2 formed with the registration rollers 62 and 76 and the rocking shaft 126 moves to the position approximately on the tangent plane 5, the force to pull the sheet in the opposite direction to the sheet conveyance direction can be reduced. On the other hand, even when the rocking shaft 126 moves to the position shown in FIG. 6B, as the sheet separating force at the contact point N1 is approximately constant and hardly reduced.

Figure 7:
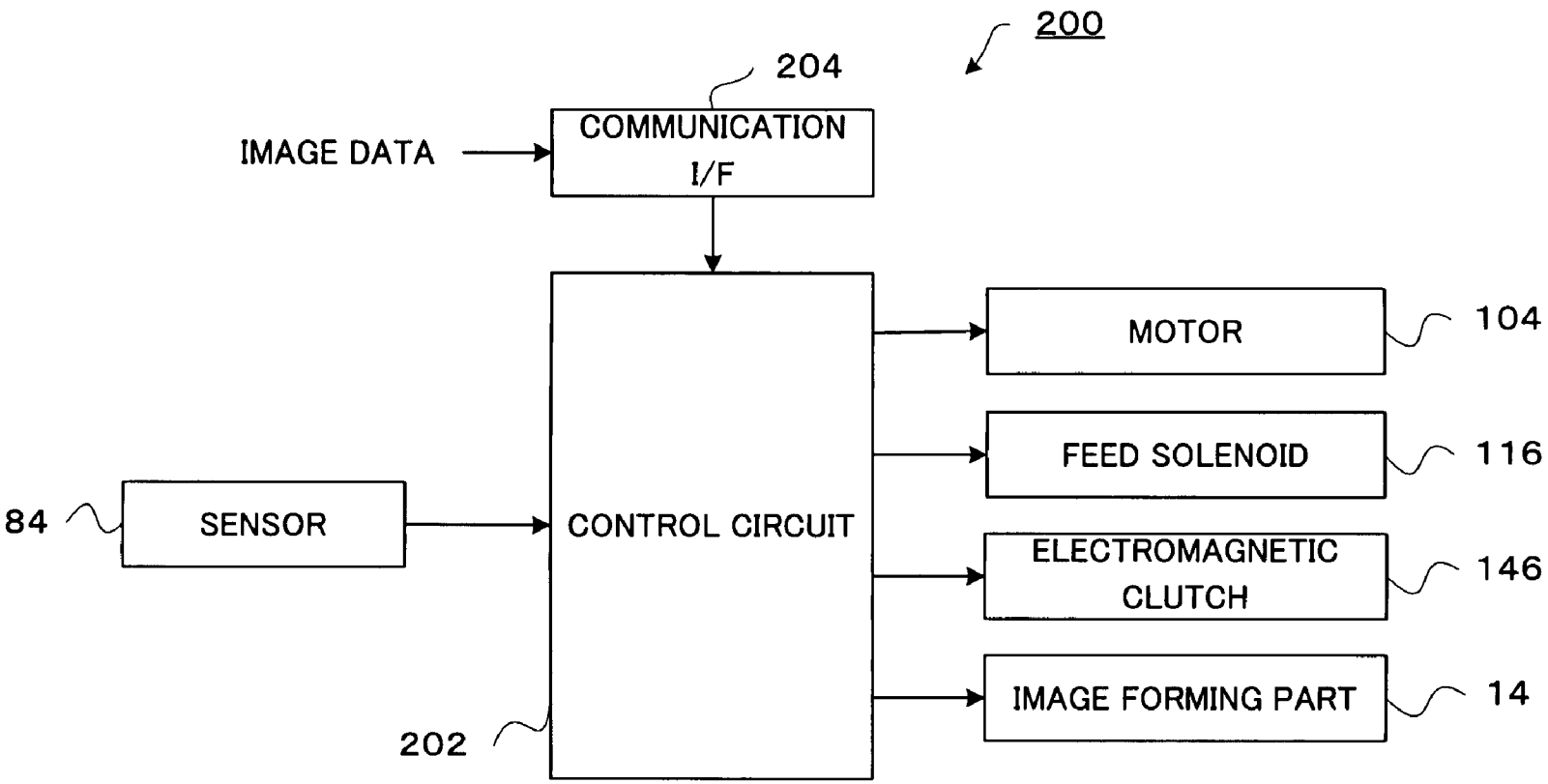
FIG. 7 is a block diagram showing a controller used in the image forming apparatus according to the first exemplary embodiment of the present invention.

FIG. 7 shows the controller 200 of the image forming apparatus 10.

The controller 200 has a control circuit 202 which inputs an output from the sensor 84. The control circuit 202 inputs image data via a communication interface 204. The image forming part 14, the motor 104, the solenoid 116 and the electromagnetic clutch 146 are controlled in accordance with an output from the control circuit 202.

Figure 8:
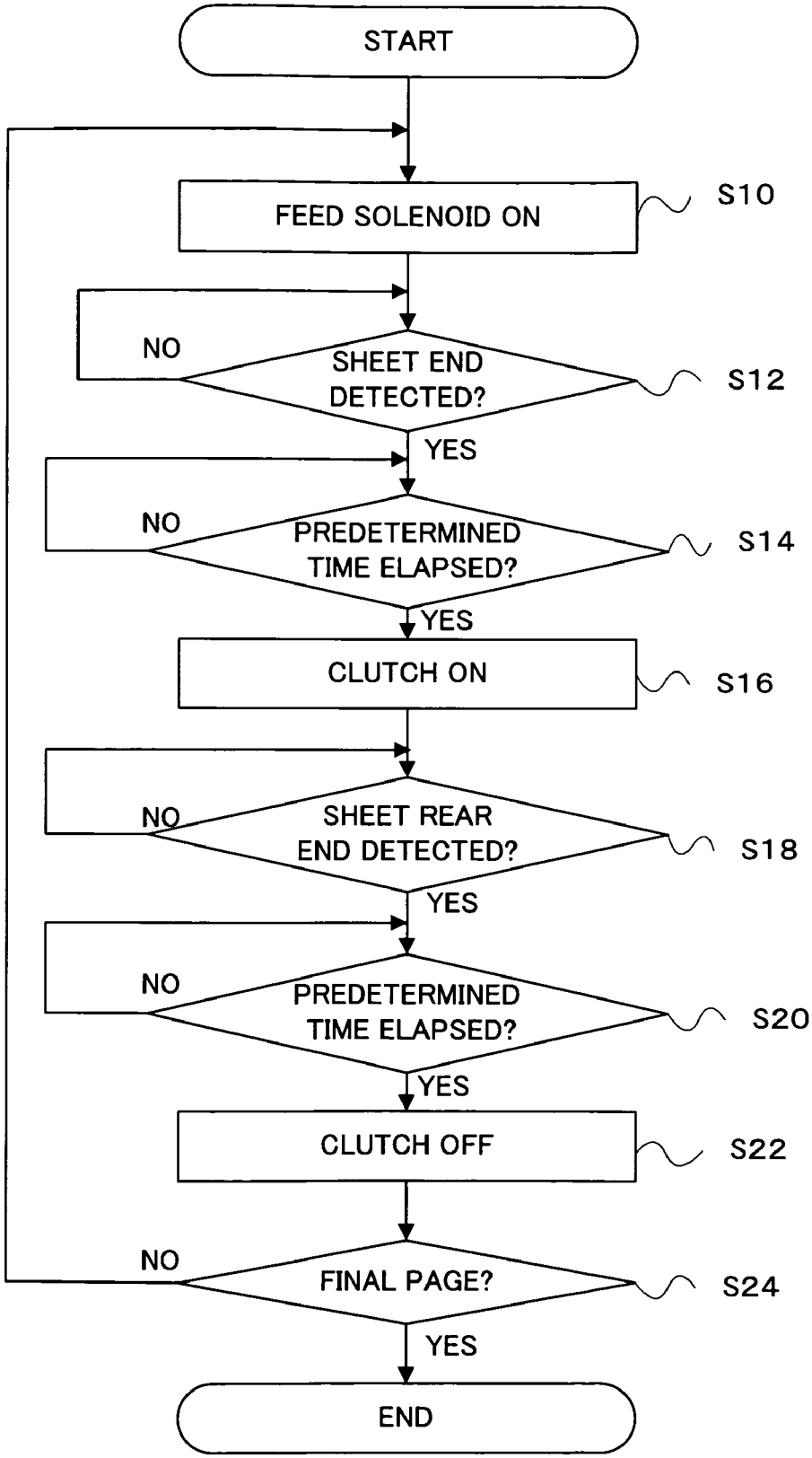
FIG. 8 is a flowchart showing an operation of the image forming apparatus according to the first exemplary embodiment of the present invention.

FIG. 8 shows a control flow of the controller 200.

When image data is inputted into the control circuit 202 via the communication interface 204 and the control flow is started, the control circuit 202 starts rotation of the motor 104, and upon reception of drive transmission from the motor 104, the driving gear 101 and driving gear 142 start rotation.

At step S10, the control circuit 202 turns the feed solenoid 116 ON to start sheet feed. When the feed solenoid 116 is turned ON, the movable member 118 moves, to release the engagement between the movable member 118 and the step member 112 of the cylindrical member 110. When the engagement between the movable member 118 and the step member 112 is released, the driven gear 102 is rotated by pressure of the pressure unit 106, and the driving gear 101 and the gear portion 102*b* of the driven gear 102 engage with each other. Then, in this state, drive transmission from the driving gear 101 to the driven gear 102 is performed, and the feed roller 58 rotates in the sheet conveyance direction together with the driven gear 102 and the rotation shaft 59, and sheet feed is started.

Further, as the cam 131 rotates in accordance with the rotation of the rotation shaft 59, the lever 132 rocks in accordance with the rotation of the cam 131. As the lever 132 starts rocking, the rocking shaft 126 inserted in the insertion hole 138 of the lever 132 moves from the position shown in FIG. 4A to the position shown in FIG. 4B. That is, when the rocking shaft 126 is in the position shown in FIG. 4B, sheet feed with the feed roller 58 is performed.

Next, at step S12, a sheet end detection signal is inputted from the sensor 84 into the control circuit 202. That is, the movable member 86 of the sensor 84 provided to cross the conveyance path 60 is pushed with the end of the conveyed sheet, then the movable member 86 is rotated about the shaft 88, and the sheet end detection signal, generated in accordance with detection of the rotation of the movable member 86 by the optical sensor, is inputted into the control circuit 202.

Next, at step S14, if it is determined that predetermined time has elapsed since the detection of the end of the sheet, the control circuit 202 turns the electromagnet clutch 146 ON at step S16. When the electromagnet clutch 146 is turned ON, the driven gear 144 is coupled with the rotation shaft 64, and the driving of the registration roller 62 in the sheet conveyance direction is transmitted from the driven gear 144 to the rotation shaft 64. The predetermined time at step S14 is determined so as to start sheet conveyance with the registration rollers 62 and 76, after the arrival of the end of the sheet at the contact point N2 formed with the registration rollers 62 and 76, the application of the conveyance force from the feed roller 58 to the sheet with its end stopped, and formation of a loop in the sheet upstream of the contact point N2. During this time, the end of the sheet where the loop is formed is pressed against the registration rollers 62 and 76, thereby skew correction is performed on the sheet.

When the driving is transmitted to the registration roller 62 and the registration roller 62 starts forward rotation, the sheet subjected to the skew correction at the contact point N2 is conveyed to the image forming part 14. In the image forming part 14, yellow, magenta, cyan and black toner images formed on the photoreceptors 22Y, 22M, 22C and 22B are sequentially transferred with the transfer rollers 50Y, 50M, 50C and 50B onto the sheet. The sheet where the four color toner images have been transferred is conveyed to the fixing device 52, then the toner image is fixed to the sheet by the fixing device 52, and discharged to the sheet discharge unit 15 with the discharge roller 78. The image formation in the image forming part 14 is performed by actuation of the image forming part 14 by the control circuit 202 after elapse of predetermined time from the input of the sheet end detection signal at step S14.

Upon start of rotation of the registration roller 62 at step S16, as the lever 132 rocks by pressure of the cam 131, the rocking shaft 126 moves to the position shown in FIG. 4A.

Next, at step S18, a sheet rear end detection signal is inputted from the sensor 84 into the control circuit 202. That is, the movable member 86 of the sensor 84, pushed with the conveyed sheet and moved to the position outside of the conveyance path 60 as shown in FIG. 4B, moves to the position crossing the conveyance path 60 as shown in FIG. 4A by passing of the rear end of the sheet around the movable member 86. Then the sheet rear end detection signal, generated by detection of the movement by the optical sensor, is inputted into the control circuit 202.

If it is determined at step S20 that predetermined time has elapsed since the detection of the rear end of the sheet, the control circuit 202 turns the electromagnetic clutch 146 OFF at step S22, thereby stops the rotation of the registration roller 62.

Next, at step S24, the control circuit 202 determines whether or not the sheet subjected to the image formation is a final sheet, based on data from the communication interface 204. If it is determined that the sheet is a final sheet, the control circuit 202 terminates the series of operations. Further, if it determined that the sheet is not a final sheet, the process returns to step S10, to repeat the series of image forming operations on the next sheet.

Figure 9A:
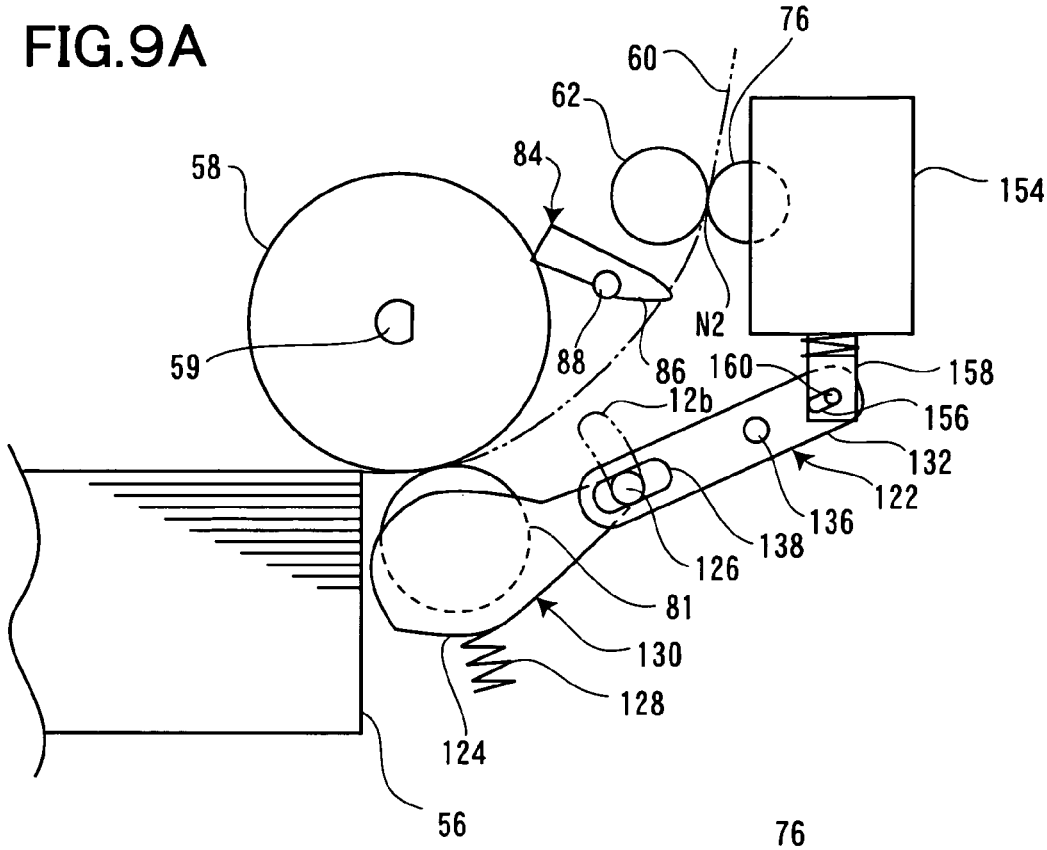
FIG. 9A is an explanatory view of the rocking shaft moving mechanism used in the image forming apparatus according to a second exemplary embodiment of the present invention, showing a state during sheet feed with the feed roller.
Figure 9B:
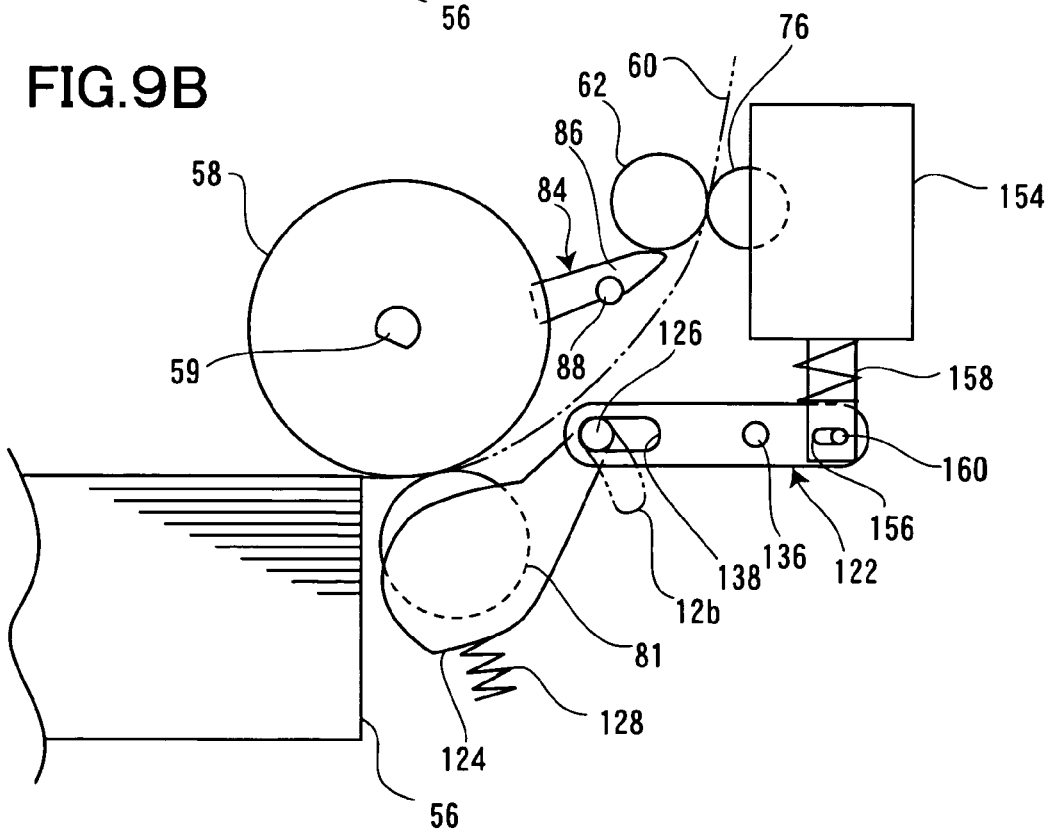
FIG. 9B is an explanatory view of the rocking shaft moving mechanism used in the image forming apparatus according to the second exemplary embodiment of the present invention, showing a state during sheet conveyance with the registration roller.

FIGS. 9A and 9B show the rocking shaft moving mechanism 130 used in the image forming apparatus 10 according to a second exemplary embodiment. In the first exemplary embodiment, the lever 132 rocks upon reception of pressure from the cam 131 and the rocking shaft 126 moves in accordance with the rocking of the lever. On the other hand, in the second exemplary embodiment, the rocking shaft moving mechanism 130 has a movement solenoid 154 to move the rocking shaft 126. The lever 132 rocks and the rocking shaft 126 moves in accordance with driving of the movement solenoid 154.

As shown in FIGS. 9A and 9B, the rocking shaft moving mechanism 130 according to the second exemplary embodiment has the lever 132 and the movement solenoid 154. The lever 132 has an insertion hole 156 at its end opposite to the end where the insertion hole 138 is formed. A projection 160 formed on a movable member 158 of the movement solenoid 154 is inserted in the insertion hole 156. Note that elements corresponding to those in the first exemplary embodiment have the same reference numerals in FIGS. 9A and 9B and the explanations of those elements will be omitted.

Upon start of sheet feed from the sheet feed cassette 56, the rocking shaft 126 is in a position on the tangent plane of the feed roller 58 passing through the contact point N1 shown in FIG. 9A. From this state, when the movable member 158 of the movement solenoid 154 moves in a direction extending downward in the figure, the right side of the lever 132 is pushed down, and the lever 132 rotates clockwise about the shaft 136. As the lever 132 rotates clockwise, the rocking shaft 126 inserted in the insertion hole 138 moves to a position shown in FIG. 9B away from the tangent plane of the feed roller 58 passing through the contact point N1. Further, when the movable member 158 moves upward from the state where the rocking shaft 126 is in the position shown in FIG. 9B, the rocking shaft 126 again moves to the position shown in FIG. 9A.

Figure 10:
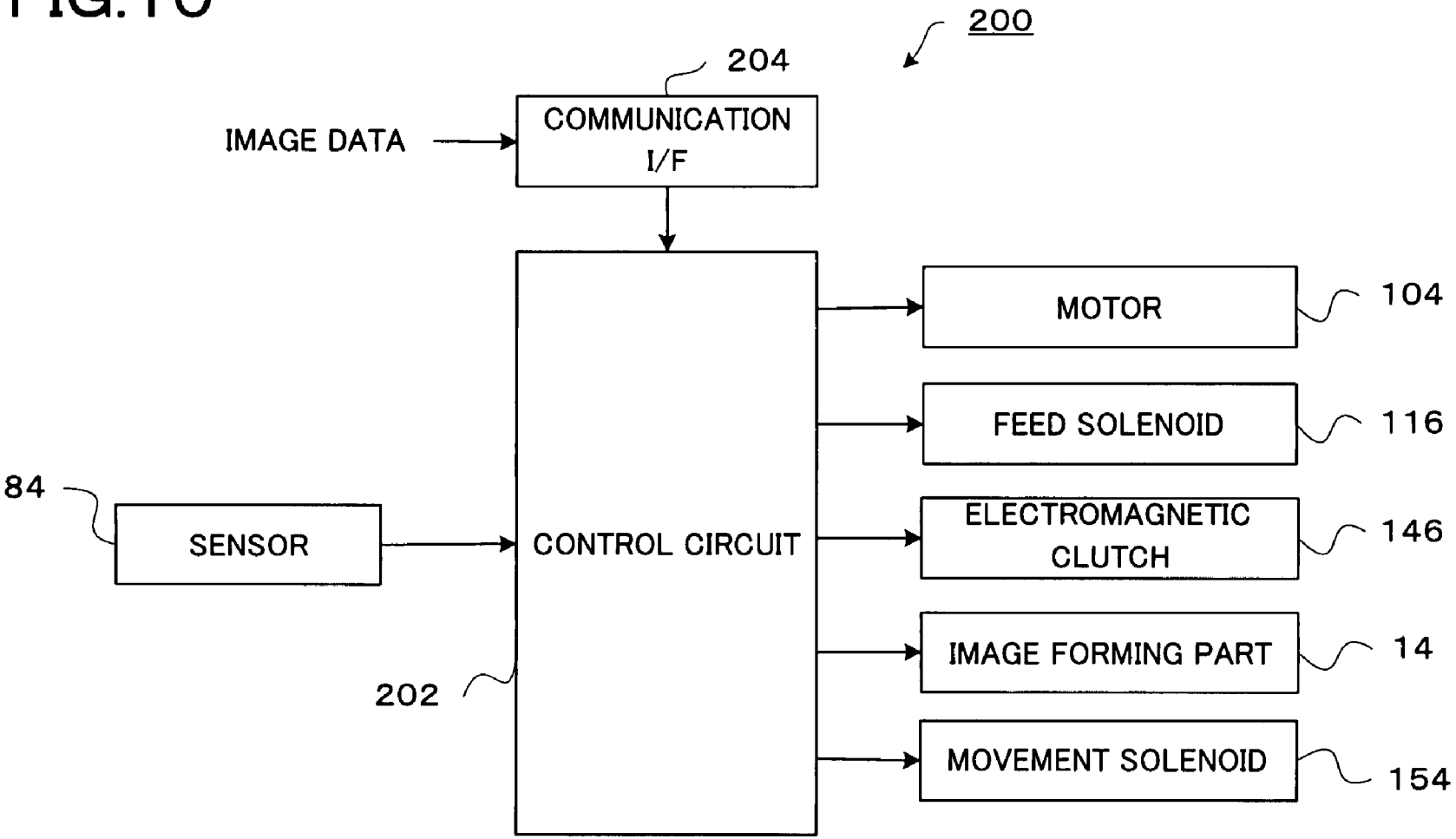
FIG. 10 is a block diagram showing the controller used in the image forming apparatus according to the second exemplary embodiment of the present invention.

FIG. 10 shows the controller 200 of the image forming apparatus 10 according to the second exemplary embodiment. In the first exemplary embodiment, the image forming part 14, the motor 104, the feed solenoid 116 and the electromagnetic clutch 146 are controlled in accordance with an output from the control circuit 202, and in the second exemplary embodiment, the movement solenoid 154, in addition to these elements, is controlled.

Figure 11:
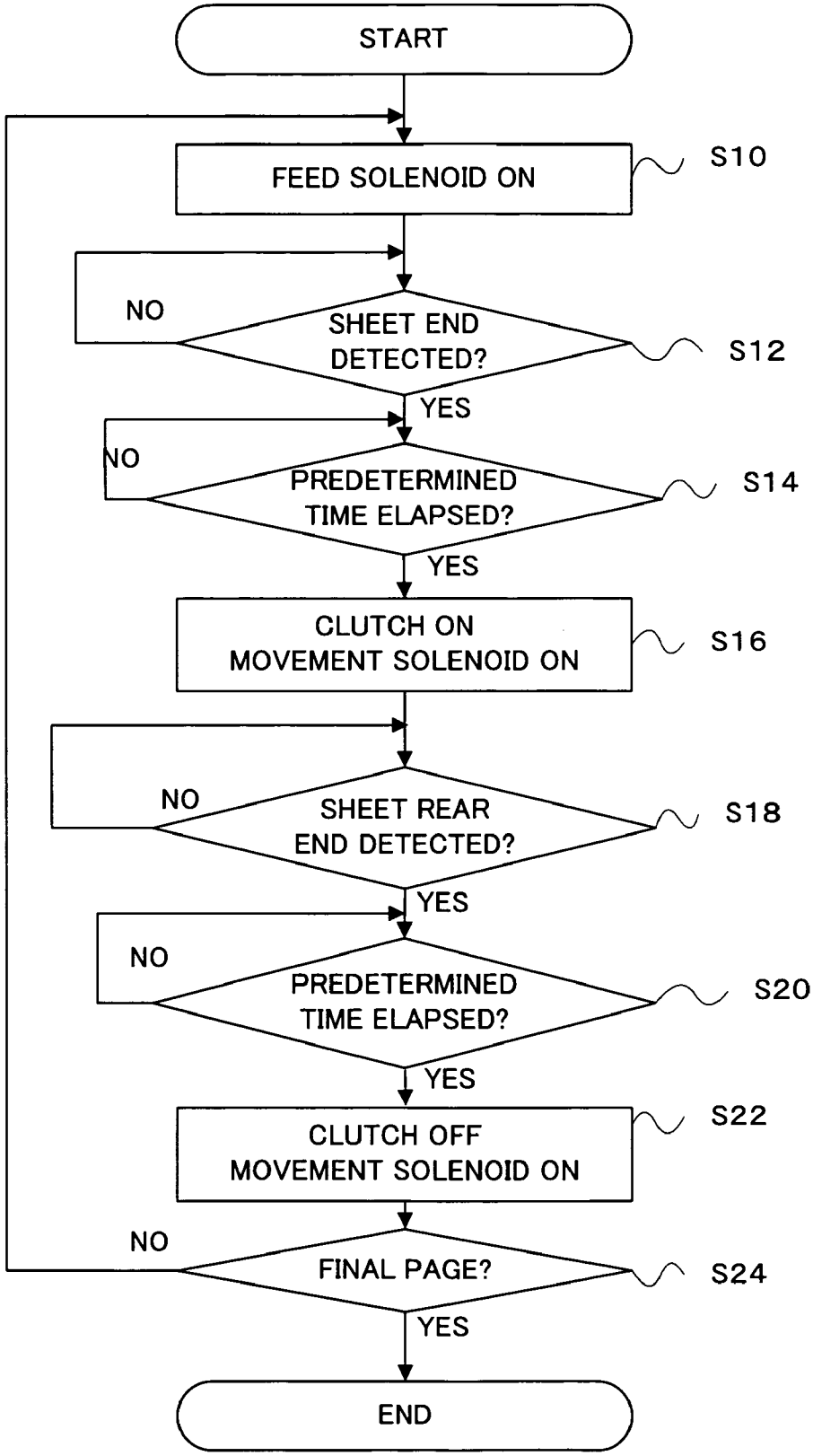
FIG. 11 is a flowchart showing the operation of the image forming apparatus according to the second exemplary embodiment of the present invention.

FIG. 11 shows the control flow of the controller 200 according to the second exemplary embodiment.

In the first exemplary embodiment, the sheet feed is started at step S10, then it is determined at step S14 that the predetermined time has been elapsed since the detection of the end of the sheet at step S12, and at step S16, the control circuit 202 turns the electromagnetic clutch 146 ON to start the rotation of the registration roller 62. On the other hand, in the second exemplary embodiment, at the same time of start of the rotation of the registration roller 62 at step S16, the movement solenoid 154 is turned ON, to move the movable member 158 in the direction extending downward, thereby move the rocking shaft 126 from the position shown in FIG. 9B to the position shown in FIG. 9A. Further, control to turn ON the movement solenoid 154 immediately after the turning ON of the electromagnet clutch 146 may be performed in place of the control to simultaneously turn ON the electromagnetic clutch 146 to start the rotation of the registration roller 62 and turn ON the movement solenoid 154 to move the rocking shaft 126.

Further, in the first exemplary embodiment, it is determined at step S20 that the predetermined time has elapsed since the detection of the passing of the rear end of the sheet around the sensor 84 at step S18, then at step S22, the control circuit 22 turns the electromagnetic clutch 146 OFF to stop the rotation of the registration roller 62. On the other hand, in the second exemplary embodiment, at the same time of the stoppage of the rotation of the registration roller 62 at step S22, the movement solenoid 154 is turned ON, to move the movable member 158 upward to move the rocking shaft 126 from the position shown in FIG. 9B to the position shown in FIG. 5A.

Figure 12A:
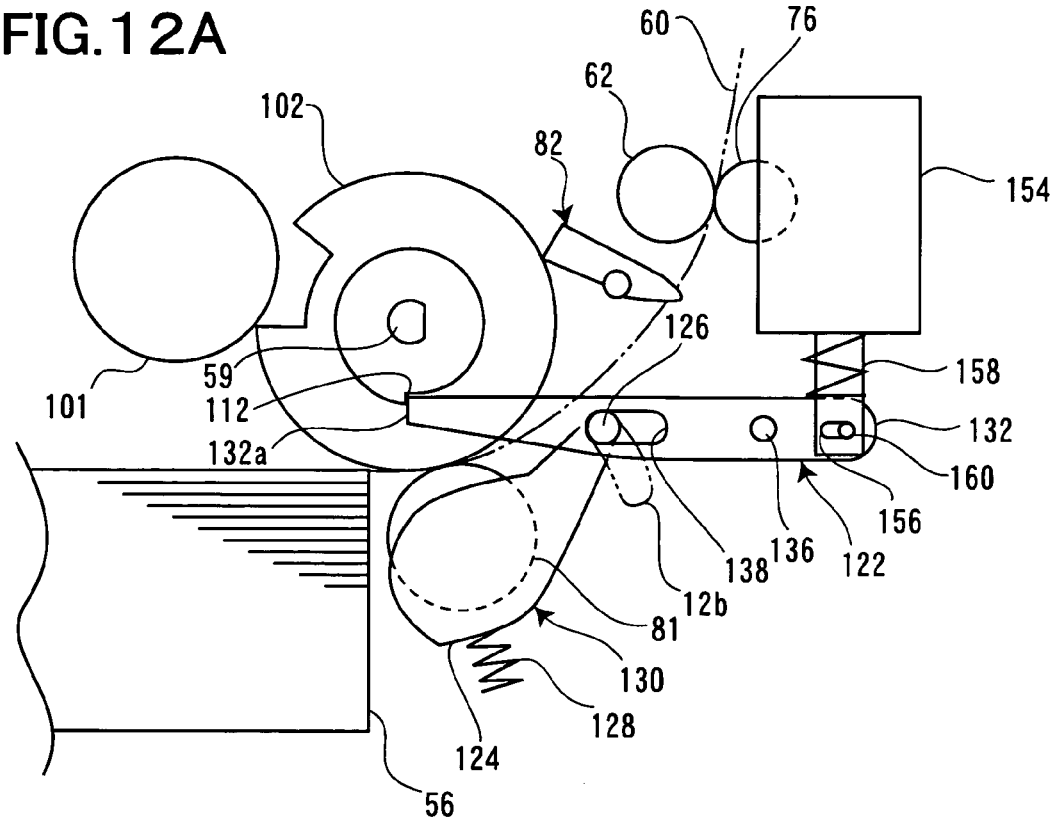
FIG. 12A is an explanatory view of the feed roller driving mechanism and the rocking shaft moving mechanism used in the image forming apparatus according to a third exemplary embodiment of the present invention, showing a state during sheet conveyance with the registration roller.
Figure 12B:
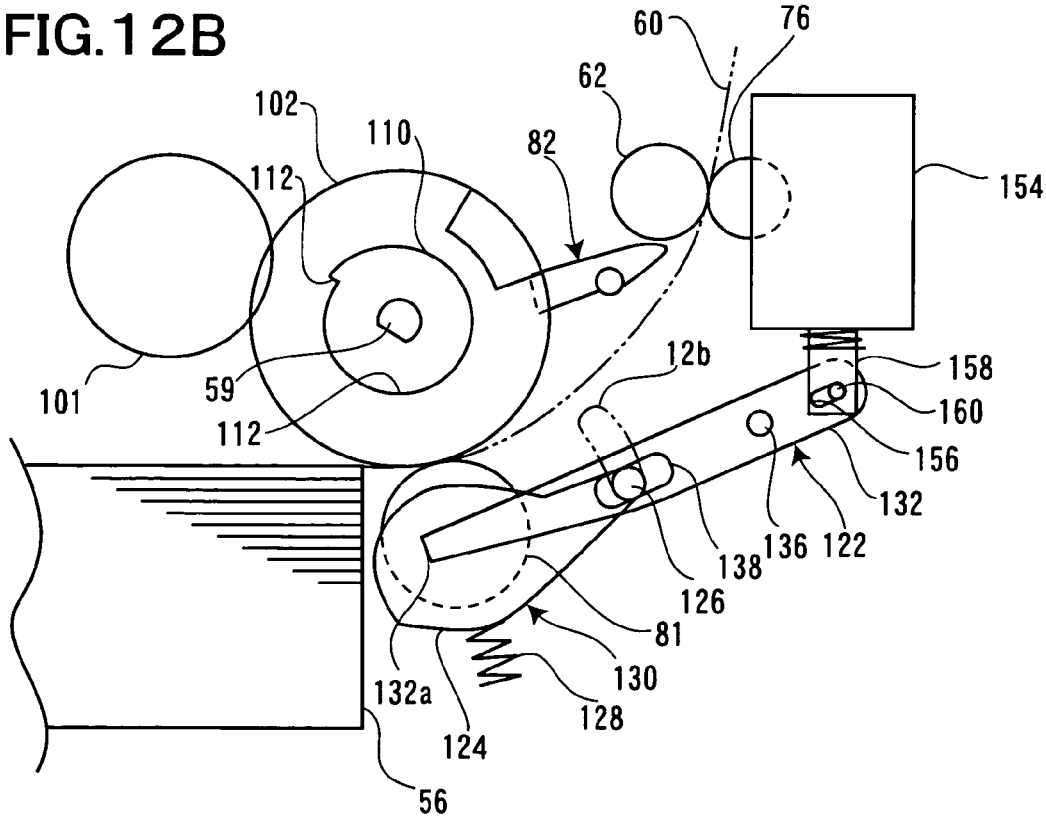
FIG. 12B is an explanatory view of the feed roller driving mechanism and the rocking shaft moving mechanism used in the image forming apparatus according to the third exemplary embodiment of the present invention, showing a state during sheet feed with the feed roller.

FIGS. 12A and 12B show the feed roller driving mechanism 100 and the rocking shaft moving mechanism 130 used in the image forming apparatus 10 according to a third exemplary embodiment. In the first and second exemplary embodiments, the feed solenoid 116 is used as a canceling unit to cancel the stopped state of the driven gear 102, and the engagement between the movable member 118 of the feed solenoid 116 and the step member 112 of the cylindrical member 110 is released, thereby the stopped state of the driven gear 102 is canceled (see FIGS. 3A and 3B). On the other hand, in the third exemplary embodiment, the movement solenoid to move the rocking shaft 126 is used as a relapse unit to cancel the stopped state of the driven gear 102.

As shown in FIGS. 12A and 12B, as in the case of the second exemplary embodiment, the rocking shaft moving mechanism 130 according to the third exemplary embodiment has the lever 132 and the movement solenoid 154. In the second exemplary embodiment, the lever 132 has the insertion hole 138 at its end opposite to the end coupled with the movement solenoid 154. On the other hand, in the third exemplary embodiment, the lever 132 further extends leftward in FIGS. 12A and 12B from the insertion hole 138. An end 132*a* of the lever 132 on the leftward-extending side is engaged with the step member 112 formed in the cylindrical member 110 when the lever 132 is in the position as shown in FIG. 12A. Accordingly, against the pressure by the pressure unit 106 (see FIGS. 3A and 3B) omitted in FIGS. 12A and 12B, the stopped state of the driven gear 102 in the position as shown in FIG. 12A is maintained. Note that the elements corresponding to those in the first exemplary embodiment have the same reference numerals in FIGS. 12A and 12B, and the explanations of the elements will be omitted.

From the state shown in FIG. 12A, when the movement solenoid 154 is turned ON to move the movable member 158 upward in the figure, the right end of the lever 132 is raised, and the lever 132 rotates counterclockwise about the shaft 136. Then, as the lever 132 rotates, the end 132*a* moves downward, away from the step member 112. When the end 132*a* moves away from the step member 112, the stopped state of the driven gear 102 is canceled, and the driven gear 102 and the driving gear 101 engage with each other. Further, as the lever 132 rotates counterclockwise, the rocking shaft 126 moves from the position on the tangent plane of the feed roller 58 passing through the contact point N1 shown in FIG. 12A to the position shown in FIG. 12B. The sheet feed with the feed roller 58 is performed when the lever 132 and the rocking shaft 126 are in the positions shown in FIG. 12B.

When the movement solenoid 154 is turned ON from the state shown in FIG. 12B, the movable member 158 moves in the direction extending downward in the figure, and the lever 132 rotates counterclockwise. The lever 132 and the rocking shaft 126 again move to the positions shown in FIG. 12A.

Figure 13:
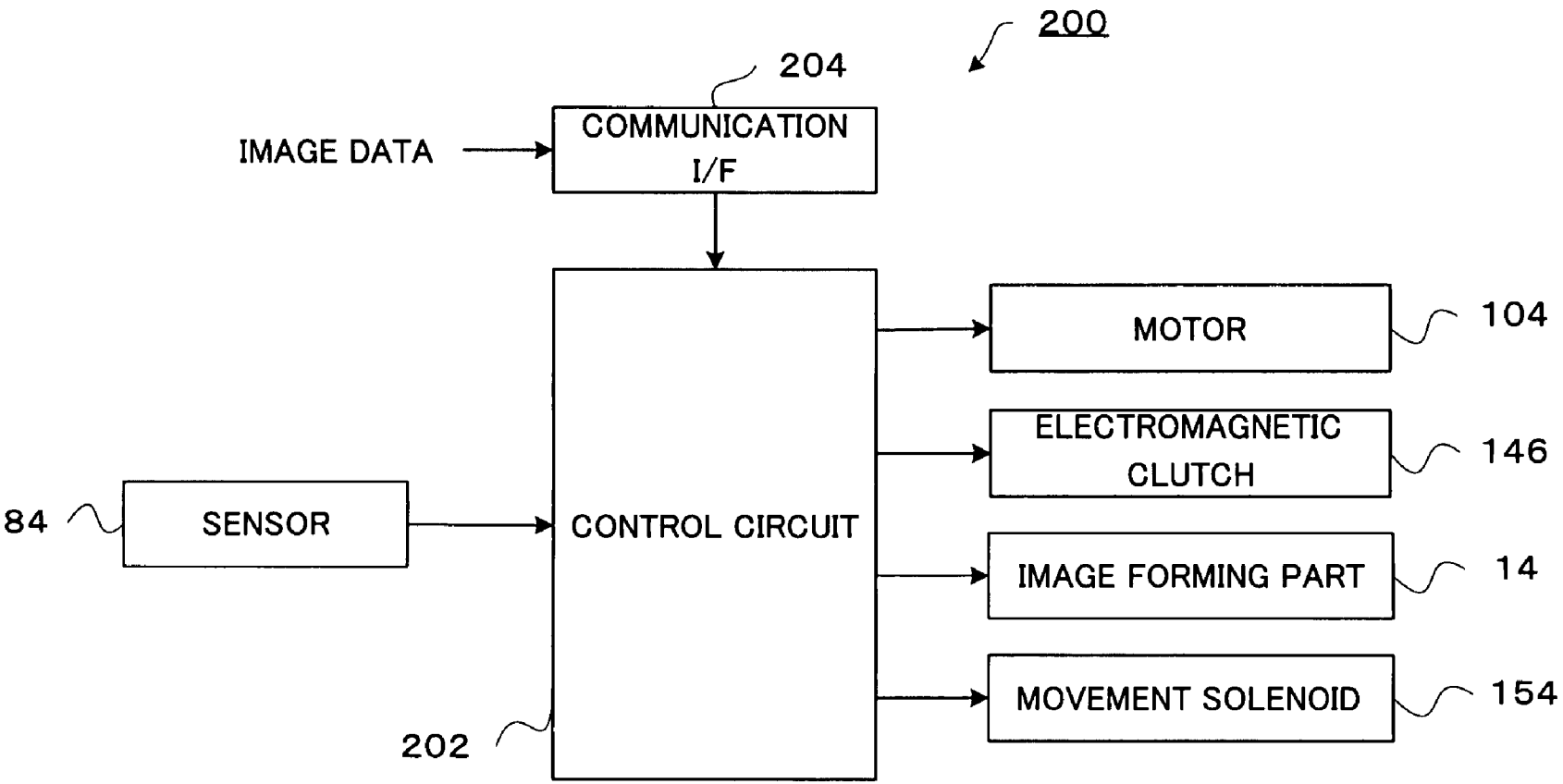
FIG. 13 is a block diagram showing the controller used in the image forming apparatus according to the third exemplary embodiment of the present invention.

FIG. 13 shows the controller 200 of the image forming apparatus 10 according to the third exemplary embodiment. In the second exemplary embodiment, the image forming part 14, the motor 104, the feed solenoid 116, the electromagnetic clutch 146 and the movement solenoid 154 are controlled in accordance with an output from the control circuit 202. On the other hand, in the third exemplary embodiment, the motor 104, the electromagnetic clutch 146, the image forming part 14 and the movement solenoid 154 are controlled.

Figure 14:
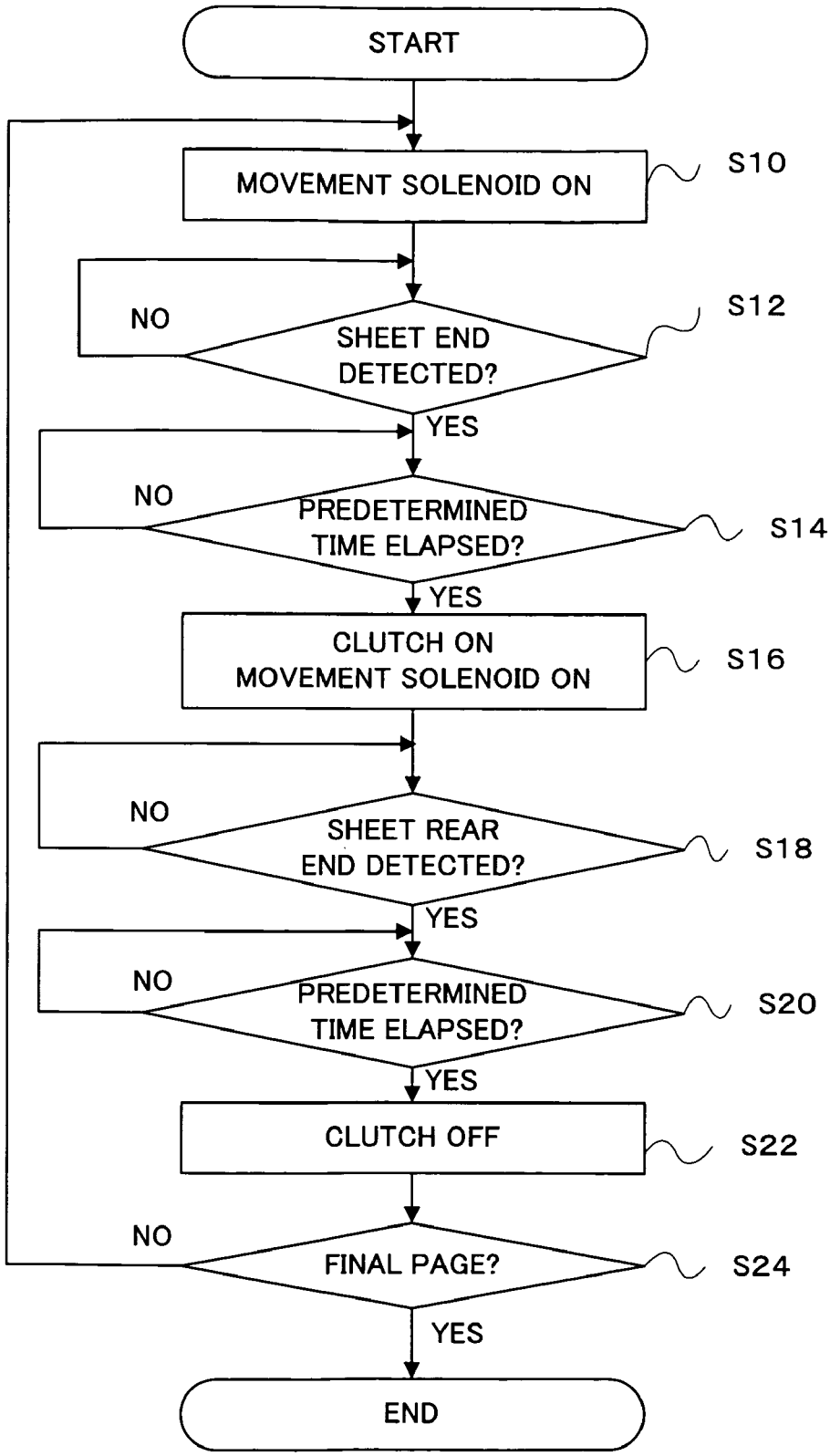
FIG. 14 is a flowchart showing the operation of the image forming apparatus according to the third exemplary embodiment of the present invention.

FIG. 14 shows the control flow of the controller 200 according to the third exemplary embodiment.

In the first and second exemplary embodiment, at step S10, the control circuit 102 turns the feed solenoid 116 ON to start the sheet feed. On the other hand, in the third exemplary embodiment, the control circuit 202 turns the movement solenoid 154 ON to start sheet feed. When the movement solenoid 154 is turned ON, the engagement between the end 132*a* of the lever 132 and the step member 112 of the cylindrical member 110 is released. The rotation driving from the driving gear 101 is transmitted via the driven gear 102 to the feed roller 58, thereby the sheet feed is started. Further, when the movement solenoid 154 is turned ON at step S10, the rocking shaft 126 moves from the position shown in FIG. 12A to the position shown in FIG. 12B.

When it is determined at step S14 that the predetermined time has elapsed since the input of the sheet end detection signal from the sensor 84, the control circuit 202 turns the electromagnetic clutch 146 ON to start the rotation of the registration roller 62 at step S16, as in the case of the first and second exemplary embodiments. Then the control circuit 202 turns the movement solenoid 154 ON at the same time of the turning ON of the electromagnetic clutch 146, to move the movable member 158 in the direction extending downward, thereby move the rocking shaft 126 from the position shown in FIG. 12B to the position shown in FIG. 12A.

Then, it is determined at step S20 that the predetermined time has elapsed since the input of the sheet rear end detection signal from the sensor 84 at step S18, the control circuit 202 turns the electromagnetic clutch 146 OFF to stop the rotation of the registration roller 62.

Figure 15A:
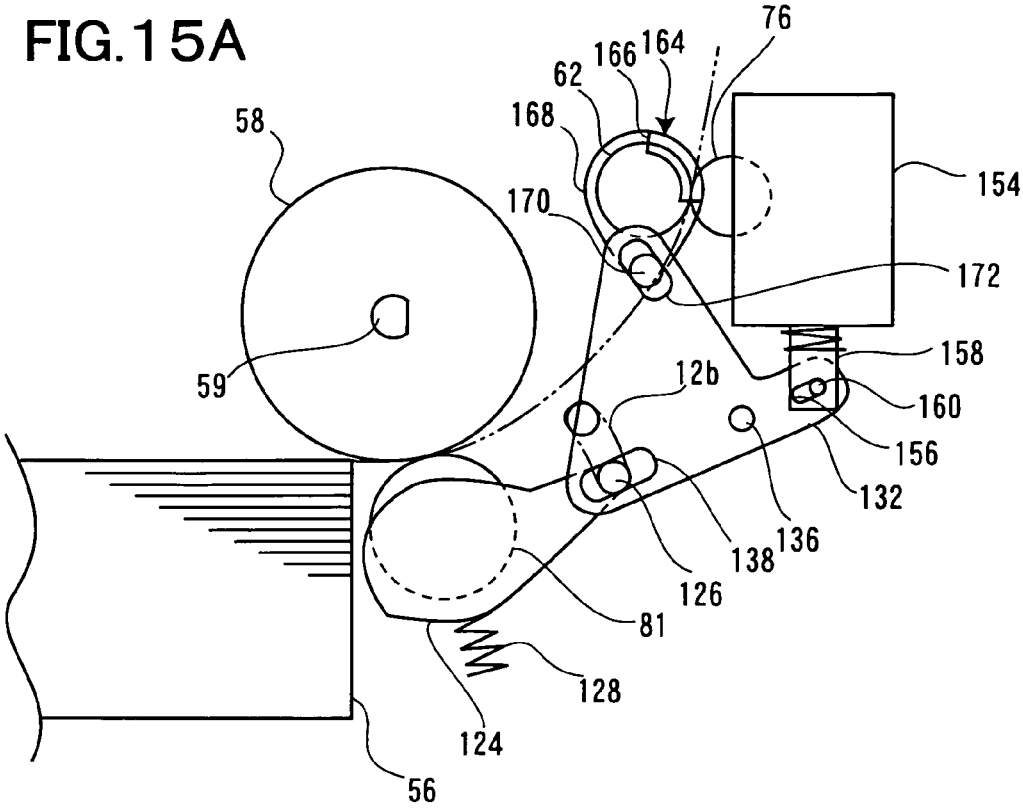
FIG. 15A is an explanatory view of the rocking shaft moving mechanism used in the image forming apparatus according to a fourth exemplary embodiment of the present invention, showing a state during sheet feed with the feed roller.
Figure 15B:
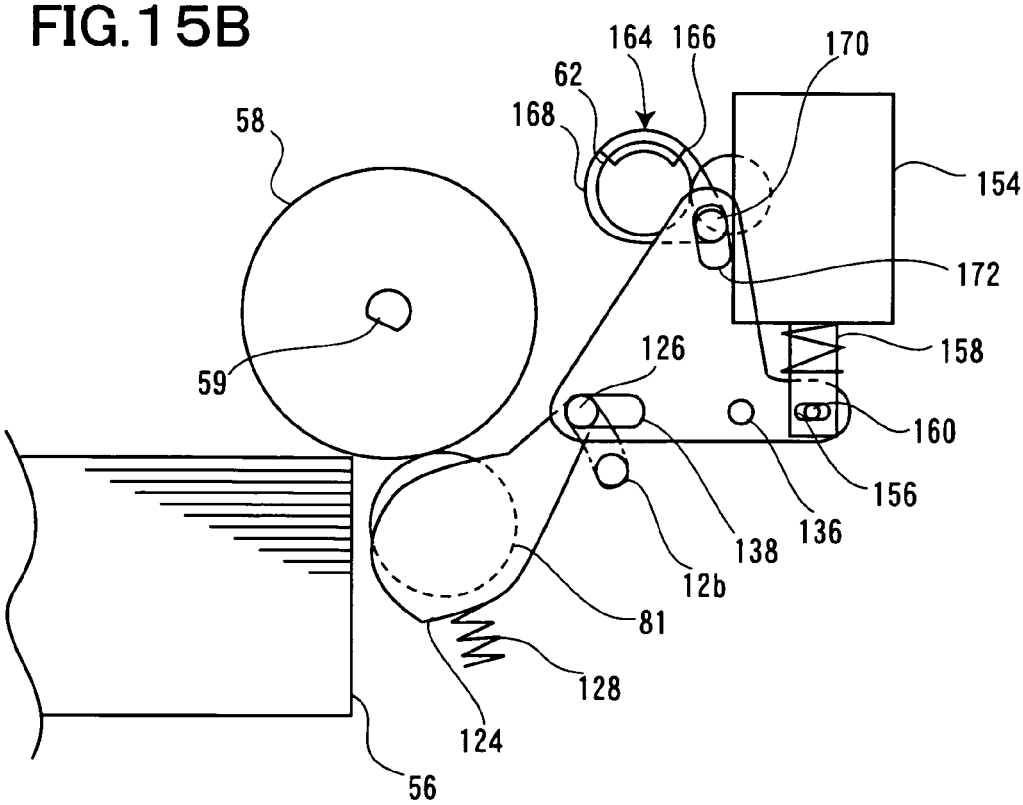
FIG. 15B is an explanatory view of the rocking shaft moving mechanism used in the image forming apparatus according to the fourth exemplary embodiment of the present invention, showing a state during sheet conveyance with the registration roller.

FIGS. 15A and 15B show the feed roller driving mechanism 100 and the rocking shaft moving mechanism 130 used in the image forming apparatus 10 according to a fourth exemplary embodiment. In the first to third exemplary embodiments, the electromagnetic clutch 146 is turned ON at predetermined timing, thereby the timing of sheet feed to the image forming part 14 is controlled. On the other hand, in the fourth exemplary embodiment, a gate member 164 is provided around the registration roller 62, and the gate member 164 is moved at predetermined timing, thereby the timing of the sheet feed to the image forming part 14 is controlled.

As shown in FIGS. 15A and 15B, the gate member 164 has a contact member 166 to come into contact with a sheet, a support member 168 to movably supports the contact member 166 and a shaft 170 provided in the support member 168. The contact member 166 moves between a first position as shown in FIG. 15A and a second position as shown in FIG. 15B. When the contact member 166 is in the first position shown in FIG. 15A, it comes into contact with the end of a sheet, to which a conveyance force is applied from the feed roller 58, thereby prevents movement of the end of the sheet. In the second position, the contact member 166 moves away from the end of the sheet which is prevented from moving, thereby allows movement of the end of the sheet in the direction of the image forming part 14.

The support member 168, having e.g. an approximately disk shape, is rotatably attached coaxially with the registration roller 62. The shaft 170 is provided to be projected from the support member 168 in a position different from the rotational center of the support member 168.

The shaft 170 is inserted into an insertion hole 172 formed in the lever 132. The insertion hole 172 is formed on the upper side of a line connecting the insertion hole 138 in which the rocking shaft 126 is inserted with the insertion hole 156 used in coupling with the movement solenoid 154. The insertion hole 172 has a function of transmitting rocking of the lever 132 to the gate member 164.

In the fourth exemplary embodiment, when the movement solenoid 154 is turned ON from the state shown in FIG. 15A, the movable member 118 moves in a direction extending downward in the figure, thereby the lever 132 rotates clockwise about the shaft 136. Then, as the lever 132 rotates clockwise, the contact member 166 of the gate member 164 moves from the position to prevent movement of an end of a sheet to the position to allow the movement of the end of the sheet, and the rocking shaft 126 moves from the position shown in FIG. 15A to the position shown in FIG. 15B. On the other hand, when the movement solenoid 154 is turned ON from the state shown in FIG. 15B, the contact member 166 of the gate member 164 moves from the position to allow the movement of the end of the sheet to the position to prevent the movement of the end of the sheet, and the rocking shaft 126 moves from the position shown in FIG. 15B to the position shown in FIG. 15A. In this manner, the movement solenoid 154 to move the rocking shaft 126 is also used as a gate moving unit to move the gate member 164.

The image forming apparatus 10 according to the fourth exemplary embodiment does not have the electromagnetic clutch 146 (see FIG. 2) used in the first to third exemplary embodiments. The registration roller 62 receives drive transmission from the motor 104 and rotates at the same timing of that of the feed roller 58.

Figure 16:
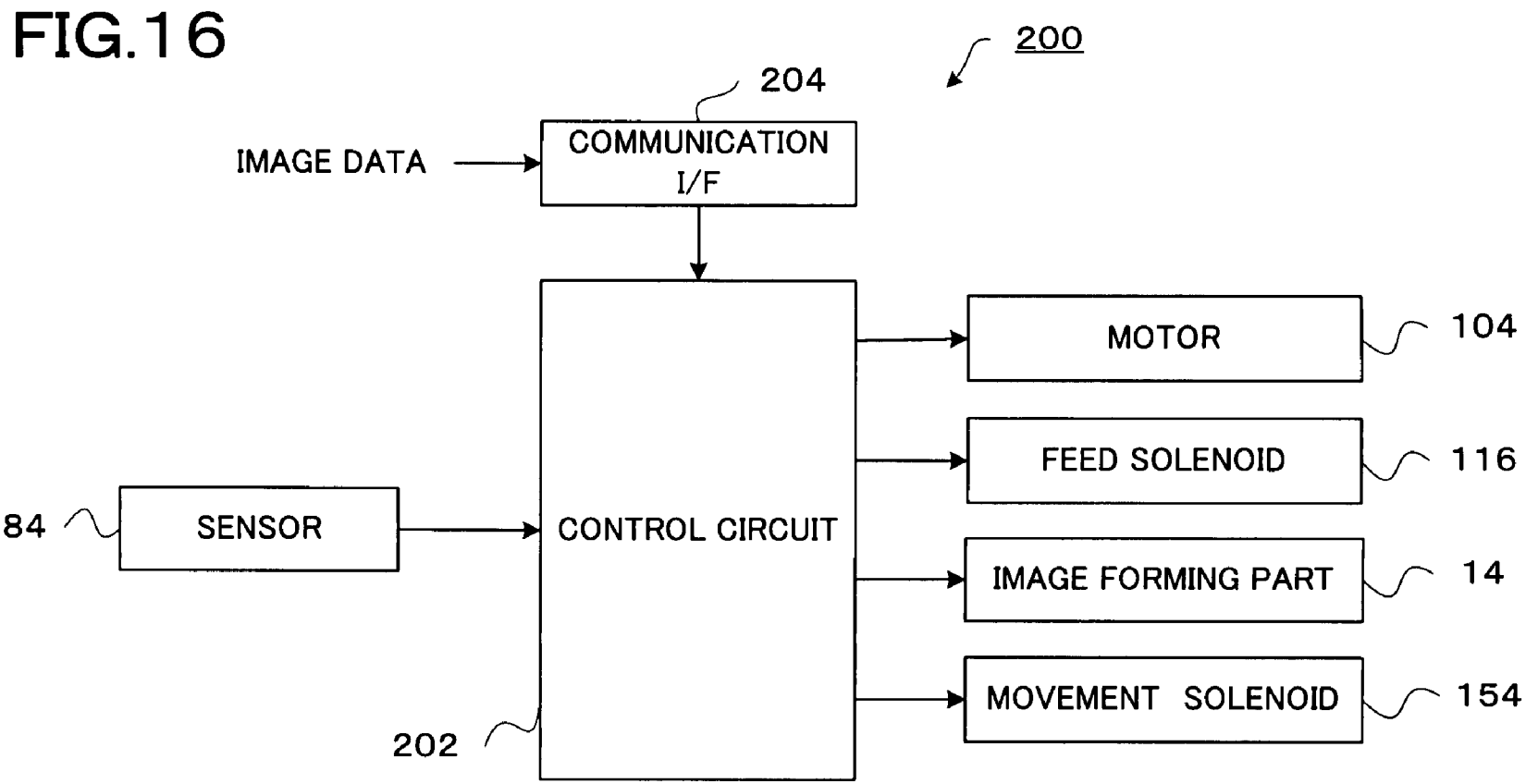
FIG. 16 is a block diagram showing the controller used in the image forming apparatus according to the fourth exemplary embodiment of the present invention.

FIG. 16 shows the controller 200 of the image forming apparatus 10 according to the fourth exemplary embodiment. In the fourth exemplary embodiment, the image forming part 14, the motor 104, the feed solenoid 116 and the movement solenoid 154 are controlled in accordance with an output from the control circuit 202.

Figure 17:
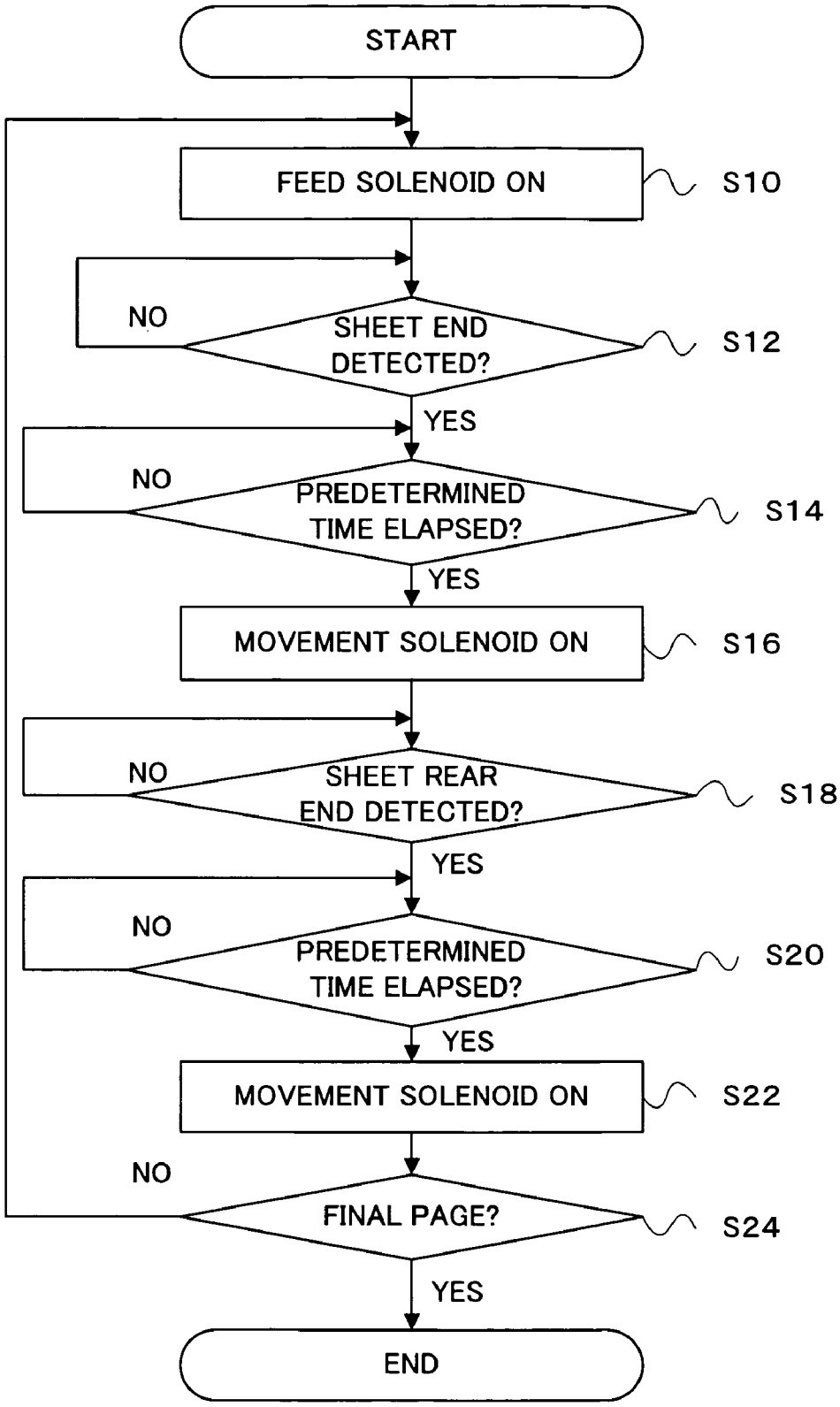
FIG. 17 is a flowchart showing the operation of the image forming apparatus according to the fourth exemplary embodiment of the present invention.

FIG. 17 shows the control flow of the controller 200 according to the fourth exemplary embodiment.

In the present exemplary embodiment, as in the case of the first and second exemplary embodiments, at step S10, the control circuit 202 turns the feed solenoid 116 ON to start sheet feed.

When it is determined at step S14 that the predetermined time has elapsed since the input of the sheet end detection signal from the sensor 84 at step 12, then at step S16, the control circuit 202 turns the movement solenoid 154 ON to move the movable member 158 in the direction extending downward in the figure, to rotate the lever 132 clockwise, to move the gate member 164 to the position to allow movement of the end of the sheet, and move the rocking shaft 126 to the position shown in FIG. 15B.

When it is determined at step S20 that the predetermined time has elapsed since the input of the sheet rear end detection signal from the sensor 84 at step S18, the control circuit 202 turns the movement solenoid 154 ON to return the movable member 158 upward, to rotate the lever 132 counterclockwise, to move the gate member 164 to the position to prevent movement of the end of the sheet, and return the rocking shaft 126 to the position in FIG. 15A.

Figure 18A:
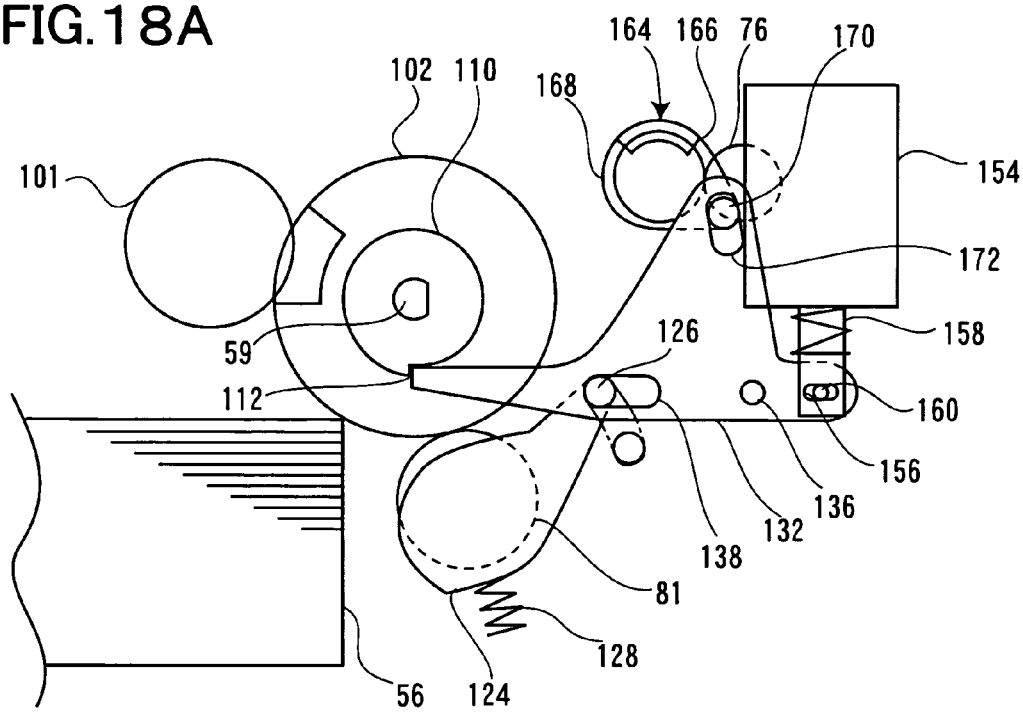
FIG. 18A is an explanatory view of the rocking shaft moving mechanism used in the image forming apparatus according to a fifth exemplary embodiment of the present invention, showing a state during sheet feed with the feed roller.
Figure 18B:
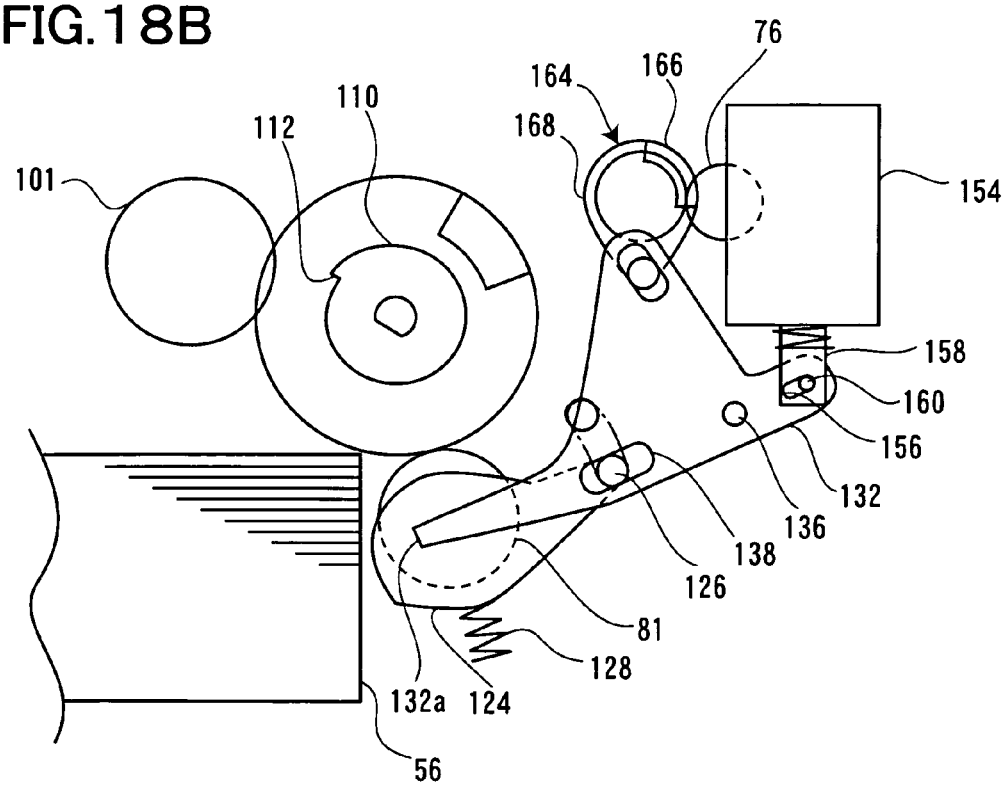
FIG. 18B is an explanatory view of the rocking shaft moving mechanism used in the image forming apparatus according to the fifth exemplary embodiment of the present invention, showing a state during sheet conveyance with the registration roller.

FIGS. 18A and 18B show the feed roller driving mechanism 100 and the rocking shaft moving mechanism 130 used in the image forming apparatus 10 according to a fifth exemplary embodiment. In the fifth exemplary embodiment, as in the case of the third exemplary embodiment, the movement solenoid 154 to move the rocking shaft 126 is also used as a canceling unit to cancel the stopped state of the driven gear 102. Further, in the fifth exemplary embodiment, as in the case of the fourth exemplary embodiment, the gate member 164 is provided around the registration roller 62, and the gate member 164 is moved at predetermined timing using the movement solenoid 154, thereby timing of sheet feed to the image forming part 14 is controlled. That is, in the fifth exemplary embodiment, the movement solenoid 154 is also used as a canceling unit to cancel the stopped state of the driven gear 102, and is also used as a gate moving unit to move the gate member 164.

As shown in FIGS. 18A and 18B, the lever 132 is rotatably supported with the shaft 136. The rocking shaft 126 provided in the rocking member 124 is inserted in the insertion hole 138, and the shaft 170 of the gate member 164 is inserted in the insertion hole 172. The lever 132 is connected with the movement solenoid 154 via the insertion hole 156. Further, in the state shown in FIG. 18A, the end 132*a* of the lever 132 is engaged with the step member 112 formed in the cylindrical member 110.

When the movement solenoid 154 is turned ON from the state shown in FIG. 18A, the movable member 118 moves upward in the figure, and the lever 132 rotates counterclockwise about the shaft 136. As the lever 132 rotates counterclockwise, the contact member 166 of the gate member 164 moves from a position to prevent movement of an end of a sheet to a position to allow the movement of the end of the sheet. The rocking shaft 126 moves from the position shown in FIG. 18A to the position shown in FIG. 18B, and the end 132*a* of the lever 132 moves to a position where the end 132*a* is not engaged with the step member 112.

On the other hand, when the movement solenoid 154 is turned ON from the state shown in FIG. 18B, the movable member 118 moves downward in the figure, and the gate member 164 moves to the position to prevent the movement of the end of the sheet. The rocking shaft 126 moves to the position shown in FIG. 18A, and the end 132*a* of the lever 132 moves to the position where the end 132*a* is engaged with the step member 112.

Figure 19:
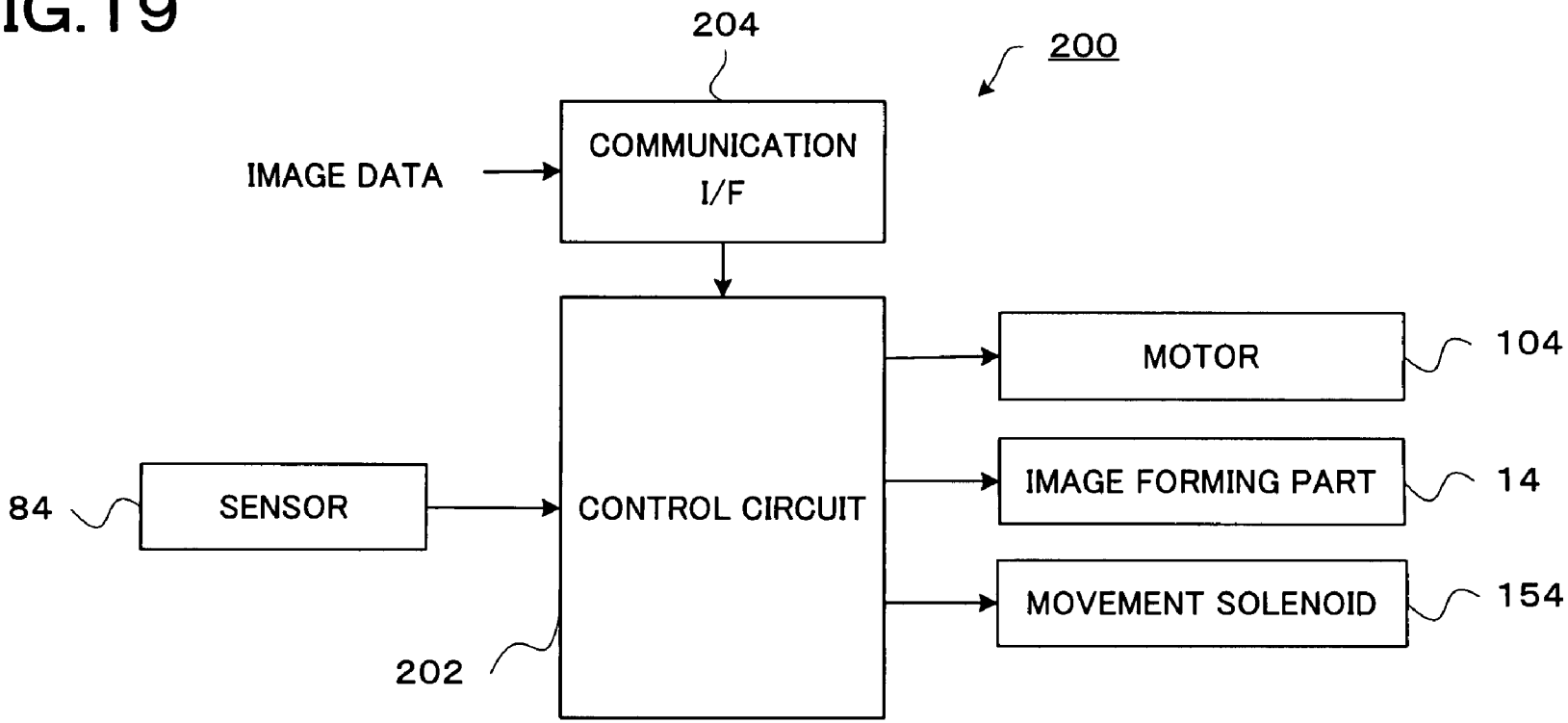
FIG. 19 is a block diagram showing the controller used in the image forming apparatus according to the fifth exemplary embodiment of the present invention.

FIG. 19 shows the controller 200 of the image forming apparatus 10 according to the fifth exemplary embodiment. In the fifth exemplary embodiment, the image forming part 14, the motor 104 and the movement solenoid 154 are controlled in accordance with an output from the control circuit 202.

Figure 20:
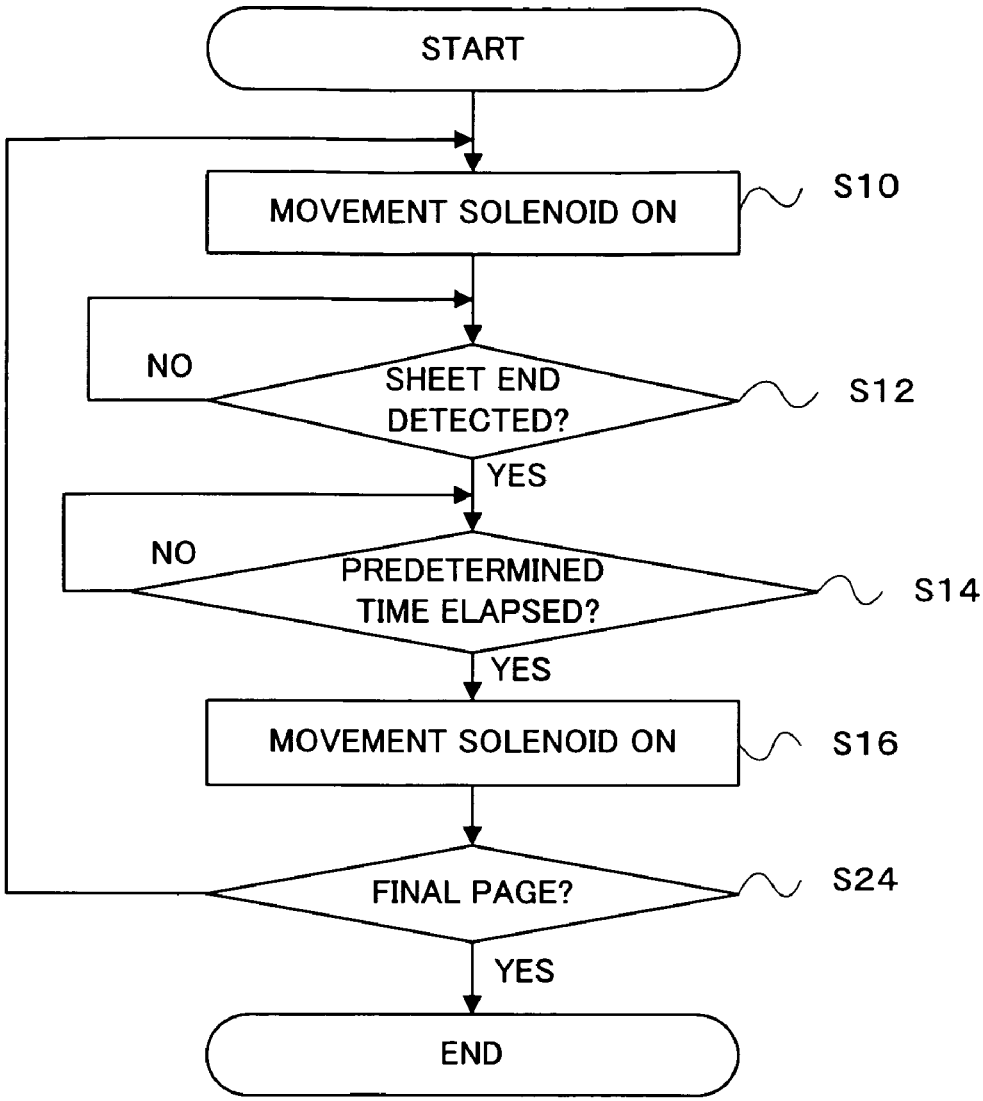
FIG. 20 is a flowchart showing the operation of the image forming apparatus according to the fifth exemplary embodiment of the present invention.

FIG. 20 shows the control flow of the controller 200 according to the fifth exemplary embodiment.

In the present exemplary embodiment, as in the case of the third exemplary embodiment, the control circuit 202 turns the movement solenoid 154 ON to start sheet feed. When the movement solenoid 154 is turned ON, the engagement between the end 132*a* of the lever 132 and the step member 112 of the cylindrical member 110 is released, then rotation driving from the driving gear 101 is transmitted via the driven gear 102 to the feed roller 58, and sheet feed is started. Further, when the movement solenoid 154 is turned ON at step S10, the rocking shaft 126 moves from the position shown in FIG. 20A to the position shown in FIG. 20B. Further, when the movement solenoid 154 is turned ON at step S10, the gate member 164 moves to the position to prevent the movement of the end of the sheet.

When it is determined at step S14 that the predetermined time has elapsed since the input of the sheet end detection signal from the sensor 84 at step S12, then at step S1, the control circuit 202 turns the movement solenoid 154 ON to move the movable member 158 in the direction extending downward in the figure, to rotate the lever 132 clockwise, to move the gate member 164 to the position to allow movement of the end of the sheet, and move the rocking shaft 126 to the position shown in FIG. 15A, to move the end 132*a* of the lever 132 to the position where the end 132*a* is engaged with the step member 112 of the cylindrical member 110.

As described above, the present invention is applicable to an image forming apparatus such as a copier, a facsimile machine or a printer in which a sheet conveyance is performed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming part;

a sheet container that contains sheets fed to the image forming part in a stacked state;

a feed roller that feeds the sheet from the sheet container;

a separation member in press-contact with the feed roller that separates the sheet at a contact point formed between the feed roller and the separation member;

a rocking member, rockably provided with respect to a main body of the image forming apparatus, that supports the separation member; and a rocking fulcrum moving unit that moves a rocking fulcrum of the rocking member.

2. The image forming apparatus according to claim 1, wherein the rocking fulcrum moving unit moves the rocking fulcrum onto a tangent plane of the feed roller passing through the contact point.

3. The image forming apparatus according to claim 1, wherein the separation member has a separation roller connected to a torque limiter.

4. The image forming apparatus according to claim 1, further comprising:

a driving gear that receives drive transmission from a drive source and drives;

a driven gear opposite to the driving gear, having a notch portion and a gear portion, coupled with the feed roller;

a pressure unit that pressurizes the driven gear in one direction so as to preparatory-drive the driven gear to a position where the driving gear and the gear portion of the driven gear engage with each other; and a stop unit that brings the driven gear into a stopped state against pressure by the pressure unit, wherein the rocking fulcrum moving unit is also used as a canceling unit that cancels the stopped state of the driven gear by the stop unit.

5. The image forming apparatus according to claim 1, further comprising a gate member, provided between the feed roller and the image forming part, that moves between a first position in which the gate member is in contact with an end of the sheet receiving a conveyance force by the feed roller so as to prevent movement of the end, and a second position in which the gate member is away from the end of the sheet prevented from moving so as to allow the movement of the end, wherein the rocking fulcrum moving unit is also used as a gate moving unit that moves the gate member.

6. The image forming apparatus according to claim 1, wherein the rocking fulcrum moving unit has:

a cam coupled with the feed roller; and a lever that supports the rocking fulcrum, receives pressure with the cam and rocks to move the rocking fulcrum.

7. The image forming apparatus according to any one of claims 1, 2, 3, 4, 5, or 6, further comprising:

a sheet conveyance roller provided between the feed roller and the image forming part;

a detection unit that detects timing of arrival of the end of the sheet at the sheet conveyance roller; and a controller that controls the press-contact force reducing unit to reduce the press contact force of the separation member to the feed roller based on detection by the detection unit.

8. An image forming apparatus comprising:

forming means for forming an image;

containing means for containing sheets fed to the forming means in a stacked state;

feed means for feeding the sheet from the containing means;

separation means in press-contact with the feed means for separating the sheet at a contact point formed between the feed means and the separation means; and press-contact force reducing means for reducing a press contact force of the separation means to the feed means while maintaining an approximately constant sheet separating force with the separation means; and a rocking means including a rocking fulcrum. rockably provided with respect to a main body of the image forming apparatus, that supports the separation means.

* * * * *